US006861798B1

(12) United States Patent
Pan et al.

(10) Patent No.: US 6,861,798 B1
(45) Date of Patent: Mar. 1, 2005

(54) TAILORED SPACER WALL COATINGS FOR REDUCED SECONDARY ELECTRON EMISSION

(75) Inventors: Lawrence S. Pan, Los Gatos, CA (US); Donald R. Schropp, Jr., San Jose, CA (US); Vasil M. Chakarov, San Jose, CA (US); John K. O'Reilly, San Francisco, CA (US); George B. Hopple, Palo Alto, CA (US); Christopher J. Spindt, Menlo Park, CA (US); Roger W. Barton, Tofte, MN (US); Michael J. Nystrom, San Jose, CA (US); Ramamoorthy Ramesh, Silver Spring, MD (US); James C. Dunphy, San Jose, CA (US); Shiyou Pei, San Jose, CA (US); Kollengode S. Narayanan, Cupertino, CA (US)

(73) Assignees: Candescent Technologies Corporation, Los Gatos, CA (US); Candescent Intellectual Property Services, Inc., Los Gatos, CA (US)

( * ) Notice: Subject to any disclaimer, the term of this patent is extended or adjusted under 35 U.S.C. 154(b) by 0 days.

(21) Appl. No.: 09/493,697

(22) Filed: Jan. 28, 2000

Related U.S. Application Data

(63) Continuation-in-part of application No. 09/258,502, filed on Feb. 26, 1999, now Pat. No. 6,236,157.

(51) Int. Cl.[7] ..... H01J 1/62; H01J 19/42

(52) U.S. Cl. ..... 313/495; 313/292; 313/422; 313/283

(58) Field of Search ..... 313/495–497, 313/292, 238, 422, 213; 455/24, 25, 50, 51

(56) References Cited

U.S. PATENT DOCUMENTS

| | | | | |
|---|---|---|---|---|
| 5,614,781 | A | 3/1997 | Spindt et al. | 313/422 |
| 5,675,212 | A | 10/1997 | Schmid et al. | 313/422 |
| 5,726,529 | A | 3/1998 | Dean et al. | 313/495 |
| 5,872,424 | A | 2/1999 | Spindt et al. | 313/495 |
| 6,353,280 | B1 * | 3/2002 | Shibata et al. | 313/292 |
| 6,366,014 | B1 * | 4/2002 | Kuroda et al. | 313/495 |

* cited by examiner

*Primary Examiner*—Vip Patel
*Assistant Examiner*—Joseph Williams

(57) ABSTRACT

The present invention provides a spacer assembly which is tailored to provide a secondary electron emission coefficient of approximately 1 for the spacer assembly when the spacer assembly is subjected to flat panel display operating voltages. The present invention further provides a spacer assembly which accomplishes the above achievement and which does not degrade severely when subjected to electron bombardment. The present invention further provides a spacer assembly which accomplishes both of the above-listed achievements and which does not significantly contribute to contamination of the vacuum environment of the flat panel display or be susceptible to contamination that may evolve within the tube. Specifically, in one embodiment, the present invention is comprised of a spacer structure which has a specific secondary electron emission coefficient function associated therewith. The material comprising the spacer structure is tailored to provide a secondary electron emission coefficient of approximately 1 for the spacer assembly when the spacer assembly is subjected to flat panel display operating voltages.

144 Claims, 28 Drawing Sheets

TAILORED SPACER WALL COATINGS FOR REDUCED SECONDARY ELECTRON EMISSION

This application is a CIP of 09/258,502 Feb. 26, 1999, now U.S. Pat. No. 6,236,157.

TECHNICAL FIELD

The present claimed invention relates to the field of flat panel displays. More specifically, the present claimed invention relates to a spacer assembly for a flat panel display.

cl BACKGROUND ART

In some flat panel displays, a backplate is commonly separated from a faceplate using a spacer assembly. In high voltage applications, for example, the backplate and the faceplate are separated by spacer assemblies having a height of approximately 1–2 millimeters. For purposes of the present application, high voltage refers to an anode to cathode potential greater than 1 kilovolt. In one embodiment, the spacer assembly is comprised of several strips or individual wall structures each having a width of about 50 microns. The strips are arranged in parallel horizontal rows with each strip extending across the width of the flat panel display. The spacing of the rows of strips depends upon the strength of the backplate and the faceplate and the strips. Because of this, it is desirable that the strips be extremely strong. The spacer assembly must meet a number of intense physical requirements. A detailed description of spacer assemblies is found in commonly-owned co-pending U.S. patent application Ser. No. 08/683,789 by Spindt et al. entitled "Spacer Structure for Flat Panel Display and Method for Operating Same". The Spindt et al. application was filed Jul. 18, 1996, and is incorporated herein by reference as background material.

In a typical flat panel display, the spacer assembly must comply with a long list of characteristics and properties. More specifically, the spacer assembly must be strong enough to withstand the atmospheric forces which compress the backplate and faceplate towards each other. Additionally, each of the rows of strips in the spacer assembly must be equal in height, so that the rows of strips accurately fit between respective rows of pixels. Furthermore, each of the rows of strips in the spacer assembly must be very flat to insure that the spacer assembly provides uniform support across the interior surfaces of the backplate and the faceplate.

The spacer assembly must also have good stability. More specifically, the spacer assembly should not degrade severely when subjected to electron bombardment. As yet another requirement, a spacer assembly should not significantly contribute to contamination of the vacuum environment of the flat panel display or be susceptible to contamination that may evolve within the tube.

Additionally, it is desirable to have a spacer assembly which provides a secondary electron emission coefficient (SEEC) which stays at a value of approximately 1. SEEC is defined as the number of electrons emitted from a surface per electron incident on the surface. Such a value is commonly not achieved in conventional spacer assemblies, for a variety of reasons. As an example, the variation in energy of electrons impinging the spacer assembly tends to vary across the length (anode to cathode dimension) of the spacer assembly. That is, electrons impinging on the spacer assembly near the cathode have an energy which is typically much less than the energy of electrons which strike the spacer assembly near the anode. As a result of the variation in energy of impinging electrons, the secondary emission coefficient function of a conventional spacer assembly will also vary significantly from the portion of the spacer assembly near the cathode to the portion of the spacer assembly near the anode.

Thus, need exists for a spacer assembly which is tailored to provide a secondary electron emission coefficient of approximately 1 for the spacer assembly when the spacer assembly is subjected to flat panel display operating voltages. A further need exists for a spacer assembly which meets the above need and which does not degrade severely when subjected to electron bombardment. Still another need exists for a spacer assembly which does not significantly contribute to contamination of the vacuum environment of the flat panel display or be susceptible to contamination that may evolve within the tube.

DISCLOSURE OF THE INVENTION

The present invention provides a spacer assembly which is tailored to provide a secondary electron emission coefficient of approximately 1 for the spacer assembly when the spacer assembly is subjected to flat panel display operating voltages. The present invention further provides a spacer assembly which accomplishes the above achievement and which does not degrade severely when subjected to electron bombardment. The present invention further provides a spacer assembly which accomplishes both of the above-listed achievements and which does not significantly contribute to contamination of the vacuum environment of the flat panel display or be susceptible to contamination that may evolve within the tube.

In one embodiment, the present invention is comprised of a spacer structure which has a specific secondary electron emission coefficient function associated therewith. The material comprising the spacer structure is tailored to provide a secondary electron emission coefficient of approximately 1 for the spacer assembly when the spacer assembly is subjected to flat panel display operating voltages.

In another embodiment, a coating material is applied to at least a portion of a spacer wall. The coating material is selected to provide a secondary electron emission coefficient of approximately 1 for the spacer assembly when the spacer assembly is subjected to flat panel display operating voltages.

In another embodiment, the present invention is comprised of a spacer structure which has a specific secondary electron emission coefficient function associated therewith. The spacer assembly further includes a coating material applied to at least a portion of the spacer structure. The material comprising the spacer structure and the material comprising the coating material taken in combination are tailored to provide a secondary electron emission coefficient of approximately 1 for the spacer assembly when the spacer assembly is subjected to flat panel display operating voltages.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention. Additionally, although the following discussion specifically mentions spacer walls, it will be understood that the present invention is also well suited to the use with various other support structures herein referred to as spacer structures including, but not limited to, posts, crosses, pins, wall segments, T-shaped objects, and the like. However, within the present application, the term spacer structure is intended to include, but not be limited to, the various types of support structures mentioned above.

Figure 1:
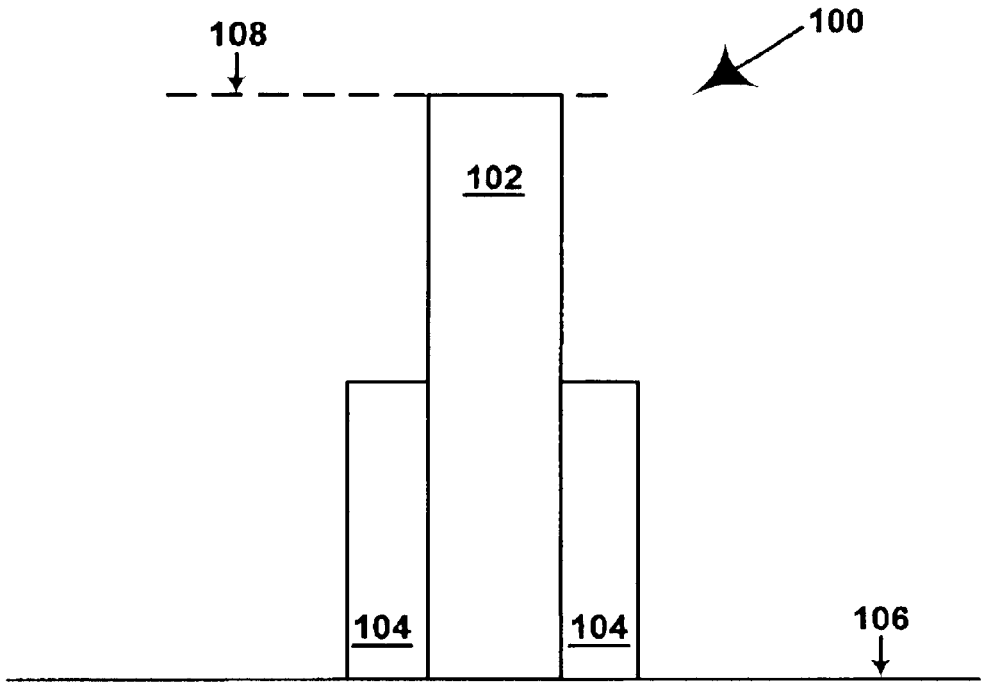
FIG. 1 is a side schematic view of a spacer assembly in which a spacer wall has a coating material applied to a portion thereof in accordance with one embodiment of the present claimed invention.

Referring now to FIG. 1, a schematic side sectional view of a spacer assembly 100 in accordance with one embodiment of the present invention is shown. In the present embodiment, spacer assembly 100 is comprised of a spacer structure 102 having a coating 104 applied to a portion thereof. In the embodiment of FIG. 1, spacer structure 102 is comprised of a combination of materials. More specifically, in the present embodiment spacer structure 102 is comprised of approximately 30 percent chromium oxide ($Cr_2O_3$), approximately 70 percent alumina ($Al_2O_3$), with a small amount of titanium (Ti) added as well. Although spacer structure 102 is comprised of such a mixture in the present embodiment, the present invention is also well suited to spacer walls having various other compositions or component ratios. Typically, spacer structure 102 will have a length (from cathode to anode) of 1.25 millimeters, and a width of 50 microns.

With reference still to FIG. 1, a coating material 104 is applied to a portion of spacer structure 102. In the present embodiment coating material 104 is comprised of $Cr_2O_3$ with approximately 3 percent titanium, Furthermore, in the present embodiment, coating material 104 is applied to spacer structure 102 with a thickness of approximately a few hundred Angstroms. It is within the scope of the present invention, however, to vary the thickness of coating material 104. As shown in FIG. 1, in the present embodiment, coating material 104 is applied to the lower portion of spacer structure 102 near where spacer structure 102 is coupled to the cathode, shown as 106, of the field emission display device. Furthermore, in this embodiment, coating material 104 is not applied to spacer structure 102 near where spacer structure 102 is coupled to the anode, shown as 108, of the field emission display device. While in the present embodiment, coating material 104 is comprised of $Cr_2O_3$ with approximately 3 percent titanium, the present invention is also well suited to the use of various other coating materials which satisfy the conditions set forth below. Additionally, although coating material 104 is applied to the lower portion of spacer structure 102 as shown in FIG. 1, the present invention is well suited to various other configurations in which coating material 104 is applied to various other portions of spacer structure 102.

Figure 2A:
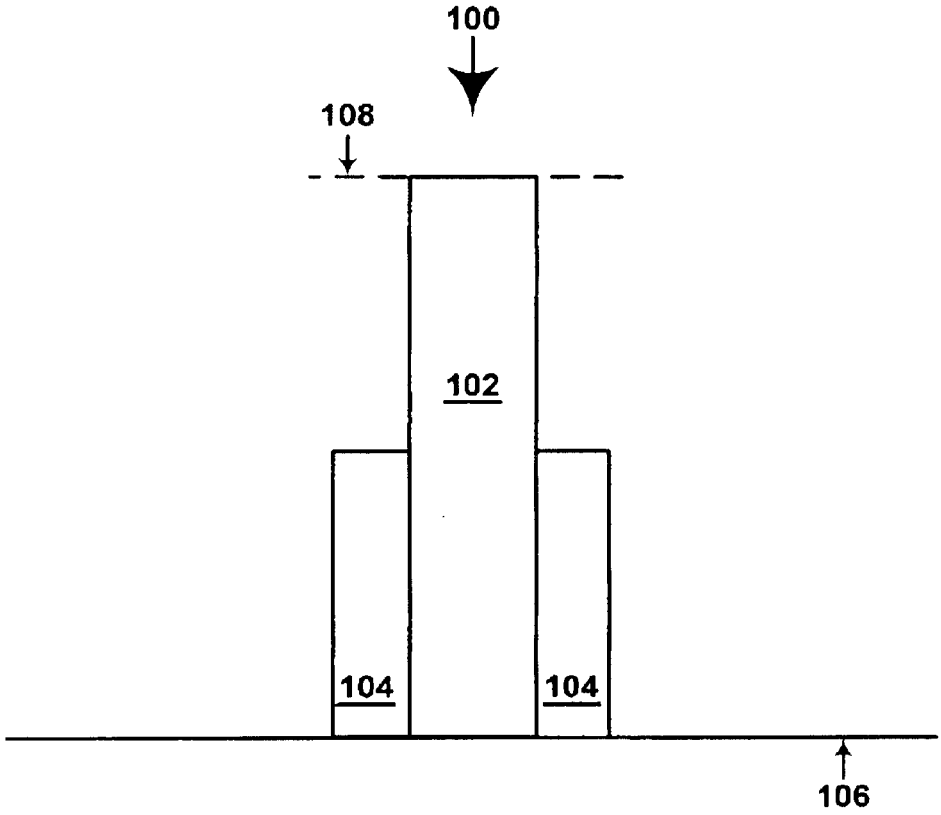
FIGS. 2A–2C are a set of Figures comparing secondary electron emission coefficient function (δ), impinging electron energies, and spacer assembly height for the spacer assembly of FIG. 1 in accordance with one embodiment of the present claimed invention.
Figure 2B:
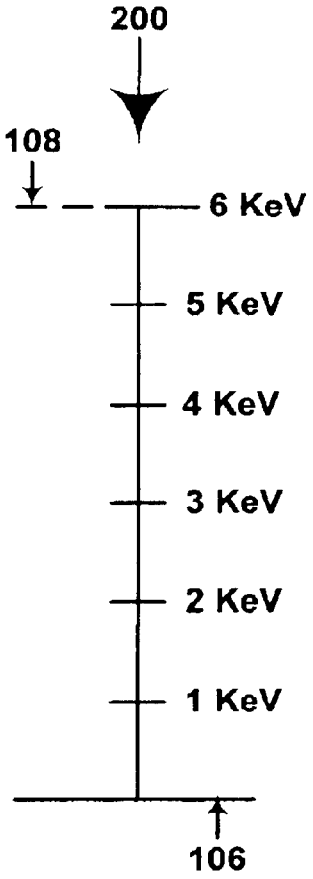
Figure 2C:
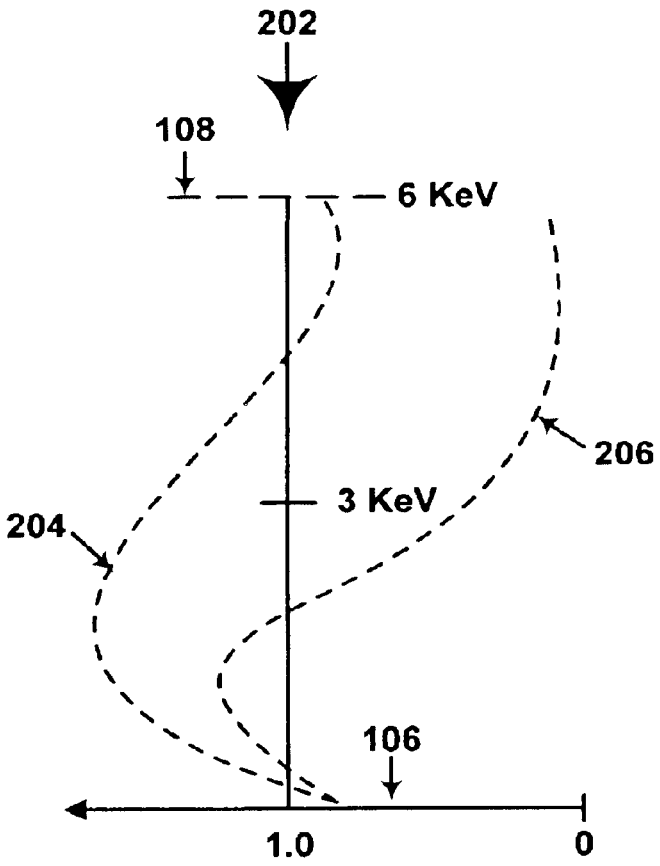

With reference now to FIGS. 2A–2C, a comparison between secondary emission coefficient function (δ), impinging electron energies, and spacer assembly height for the spacer assembly of FIG. 1 is shown. In a conventional field emission display device, electrons are accelerated from the cathode 106 towards the anode 108 using an increasing voltage potential. More specifically, the potential is at approximately 0 keV near the cathode 104 of the field emission display device. Thus, in the present invention, the voltage potential is approximately 0 keV near the base of spacer assembly 100. The voltage potential is gradually increased to a value of approximately 6 keV near the anode 108 of the field emission display device. Thus, in the present invention, the voltage potential is approximately 6 keV near the top of spacer assembly 100. This increasing voltage potential is graphically illustrated in FIG. 2B which plots voltage potential values between cathode 106 and anode 108. It will be understood that electrons which strike spacer assembly 100 of the present embodiment will have approximately equivalent to the voltage potential at that point. Thus, as can be determined by comparing FIG. 2B with FIG. 2A, in the present embodiment, coating material 104 extends from the base of spacer structure 102 to approximately the point where electrons impinging spacer assembly 100 would have approximately 3 keV.

Referring now to FIG. 2C, a graph 202 of secondary electron emission coefficient function (δ) is shown. In graph 202 of FIG. 2C, line 204 represents the secondary emission coefficient function for a bare spacer structure 102 of FIGS. 1 and 2A between 0 keV and 6 keV. Line 206 represents the secondary emission coefficient function for coating material 104 of FIGS. 1 and 2A between 0 keV and 6 keV. In order for a spacer assembly 100 to remain "electrically invisible" (i.e. not deflect electrons passing from the row electrode on the backplate (cathode 106) to pixel phosphors on the faceplate (anode 108)), the secondary electron emission coefficient function must be kept at or near the value of 1. As shown by line 204 of FIG. 2C, the secondary electron emission coefficient function for bare spacer structure 102 is much greater than 1.0 when the incident electron energy is between approximately 0 keV and less than 3 keV. However, the secondary electron emission coefficient function for bare spacer structure 102 is fairly close to a value of 1.0 when the incident electron energy is between approximately greater than 3 keV to a value of 6 KeV. Conversely, as shown by line 206 of FIG. 2C, the secondary electron emission coefficient function for coating material 104 of FIGS. 1 and 2A is fairly close to a value of 1.0 when the incident electron energy is between approximately 0 keV and less than 3 keV. However, the secondary electron emission coefficient function for coating material 104 is much less than 1.0 when the incident electron energy is between approximately greater than 3 keV to a value of 6 KeV.

Thus, the present embodiment compensates for the variation in energy of the electrons which may potentially strike the spacer assembly 100 by coating the lower portion of spacer structure 102 with coating material 104 and leaving the upper portion of spacer structure 102 uncoated or "bare". As a result, the secondary electron emission coefficient function of spacer assembly 100 is at or near a value of 1.0 at the lower portion thereof (due to the presence of coating material 104), and the secondary electron emission coefficient function of spacer assembly 100 is at or near a value of 1.0 where desired along the upper portion thereof (due to the presence of bare spacer structure 102). As a result, spacer assembly 100 of the present embodiment has a plurality of secondary electron emission coefficient functions associated therewith. Moreover, the present embodiment tailors the secondary electron emission coefficient function of spacer assembly 100 by coating a portion of spacer structure 102 with a coating material 104.

In addition to providing an "electrically invisible" spacer assembly 100 by tailoring the secondary electron emission coefficient function to have a value close to 1.0 where desired, the present invention has several other advantages associated therewith. As one example, by not significantly collecting excess charge, the present invention eliminates the need for sophisticated, difficult to manufacture, and expensive features such as electrodes or other devices necessary in some conventional spacer walls to bleed off excess charge. Hence, the present invention can be easily and inexpensively manufactured. Additionally, because spacer assembly 100 of the present embodiment reduces charge accumulation, less charge is present to be drained from the spacer wall. As a result, resistivity specifications for the bulk spacer structure 102 (and coating material 104) can be significantly relaxed. Such relaxed specifications/requirements reduce the cost of spacer structure 102 and coating material 104. Thus, the present invention can reduce manufacturing costs. Less charging also allows the resistivity of the wall material to be increased which decreases leakage current through the wall. This leads to greater field emission display efficiency.

Also, manufacturing of a spacer assembly in accordance with the present embodiment has distinct advantages associated therewith. For example, in the embodiment of FIG. 2A, the location of coating material 104 on spacer structure 102 can be altered slightly without dramatically compromising the benefits associated with the present invention. As a result, manufacturing tolerances can be loosened enough to significantly reduce manufacturing costs without severely compromising performance.

As yet another advantage, spacer assembly 100 has good stability. That is, in addition to tailoring the secondary electron emission coefficient function to a value of near 1.0 along the entire length thereof, spacer assembly 100 may not degrade severely when subjected to electron bombardment, depending on the materials used for the spacer structure and the coating or coatings. For example, if the coating is less stable than the spacer structure to electron bombardment, the configuration shown in FIG. 2A will not degrade as quickly under operation, because by far more electrons strike the upper portion of the spacer, where there is no coating. Another was to look at this is that it relaxes the stability requirements of the coating. By not degrading, spacer assembly 100 does not significantly contribute to contamination of the vacuum environment of the field emission display device. Additionally, the materials comprising spacer assembly 100 of the present embodiment (i.e. $Cr_2O_3$, $Al_2O_3$, and Ti in spacer structure 102 and $Cr_2O_3$ in coating material 104) can easily have contaminant carbon removed or washed therefrom prior to field emission display sealing processes. Actually, in one embodiment, any uncovered spacer will be less likely to collect carbon, compared to the present coating $Cr_2O_3$. Collecting carbon is not necessarily deleterious, only when electrons also strike that surface. By restricting the coating to the lower half of the wall, fewer electrons strike the carbon coated surfaces, again leading to a more stable configuration. Also, the materials comprising spacer assembly 100 of the present embodiment do not deleteriously collect carbon after the field emission display seal process. As a result, the present embodiment is not subject to the carbon-related contamination effects associated with conventional uncoated spacer walls.

Figure 3:
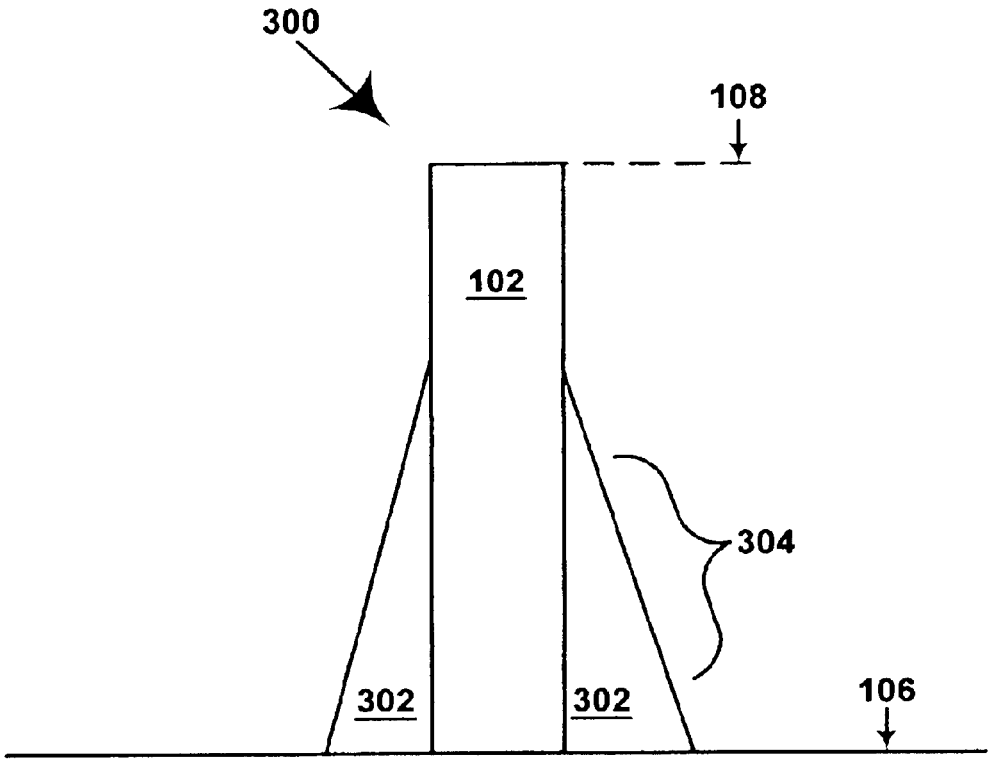
FIG. 3 is a side schematic view of a spacer assembly in which a spacer wall has a coating material of varying thickness applied to a portion thereof in accordance with one embodiment of the present claimed invention.

With reference now to FIG. 3, another embodiment of a spacer assembly 300 in accordance with the present claimed invention is shown. As in the embodiment of FIG. 1 and FIG. 2A, in this embodiment, spacer assembly 300 is comprised of a spacer structure 102 having a coating 302 applied to a portion thereof. In the embodiment of FIG. 3, spacer structure 102 is comprised of the same materials described in detail above in conjunction with the embodiment of FIGS. 1 and 2A. However, the present invention is also well suited to spacer walls having various other compositions or component ratios. Additionally, in the present embodiment, coating material 302 is comprised of $Cr_2O_3$, however, the present embodiment is also well suited to the use of various other coating materials.

With reference still to the embodiment of FIG. 3, spacer structure 102 has a coating material 302 applied thereto with varying thickness. In this embodiment, the varying thickness of coating material 302 correspondingly varies with the energy of the electrons which may impinge spacer assembly 300 such that the combination of the secondary electron emission coefficient function of coating material 302 and the secondary electron emission coefficient function of underlying spacer structure 102 combine to provide a total secondary electron emission coefficient function having a value of at or near 1.0 where desired along spacer assembly 300. More specifically, when coating material 302 is deposited to a sufficient thickness, the secondary electron emission coefficient function will be that of coating material 302. Conversely, when no coating material 302 is present, the secondary electron emission coefficient function will be that of spacer structure 102. However, when coating material 302 is thin enough (e.g. at region 304), the secondary electron emission coefficient function will be comprised partially of the secondary electron emission coefficient function of coating material 302 and partially of the secondary electron emission coefficient function of underlying spacer structure 102. Thus, the present embodiment takes into account the fact that the energy of impinging electrons increases from approximately 0 keV at the region near cathode 106 to a value of approximately 6 keV at the region near anode 108. The present embodiment then tailors the thickness of coating 302 such that the combination of the secondary electron emission coefficient function of coating material 302 and the secondary electron emission coefficient function of underlying spacer structure 102 will provide a total secondary electron emission coefficient function having a value at or near 1.0 where desired. Thus, the present embodiment generates a spacer assembly having a plurality of position varying secondary electron emission coefficient functions associated therewith.

Figure 4:
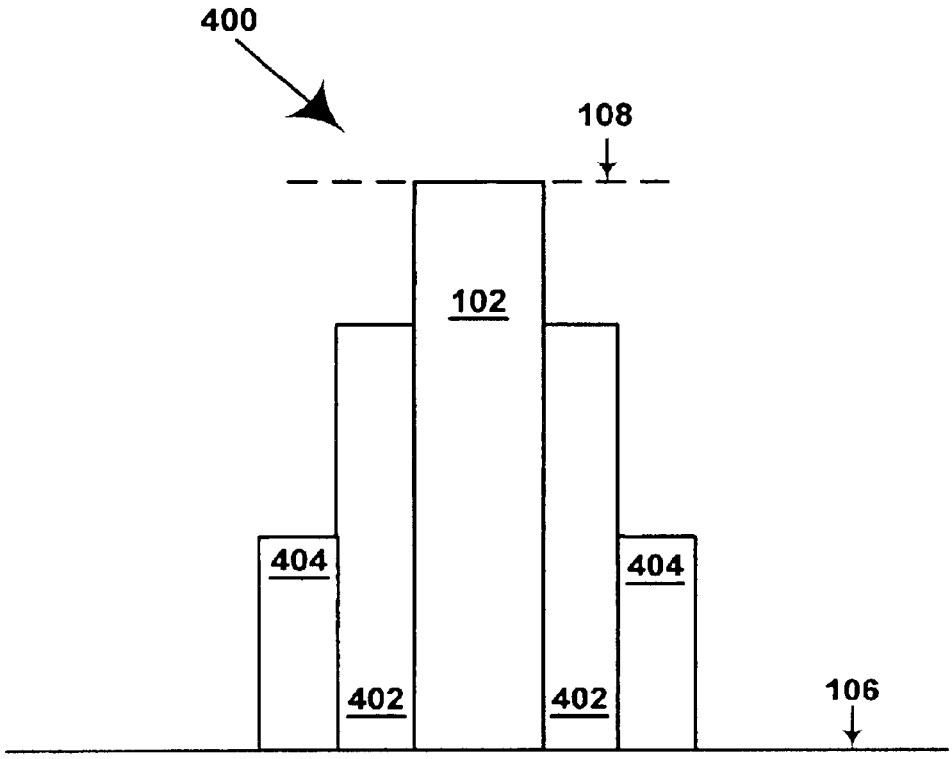
FIG. 4 is a side schematic view of a spacer assembly in which a spacer wall has a first coating material applied to a first portion thereof and a second coating material applied to a second portion thereof in accordance with one embodiment of the present claimed invention.

With reference now to FIG. 4, a side schematic view of a spacer assembly 400 is shown. In the present embodiment, a spacer structure 102 has a first coating material 402 applied to a first portion thereof and a second coating material 404 applied to a second portion thereof In the embodiment of FIG. 4, spacer structure 102 is comprised of the same materials described in detail above in conjunction with the embodiment of FIGS. 1, 2A, and 3. However, the present invention is also well suited to spacer walls having various other compositions or component ratios. Additionally, in the present embodiment, second coating material 404 is comprised of $Cr_2O_3$, however, the present embodiment is also well suited to the use of various other coating materials. In the embodiment of FIG. 4, first coating material 402 is comprised of $Nd_2O_3$. As shown in FIG. 4, first coating material 402 is exposed only where impinging electrons will have an energy in the range of approximately 2–4 keV.

Thus, by selecting a material (e.g. $Nd_2O_3$) which has a secondary electron emission coefficient function having a value of at or near 1.0 for such a potential range, the present embodiment tailors the overall secondary electron emission coefficient function to the desired value. That is, the present embodiment has a coating material 404 with a secondary electron emission coefficient function of at or near 1.0 for lower energies (e.g. 0–2 keV) disposed near cathode 106. The present embodiment then has a coating material 402 with a secondary electron emission coefficient function of at or near 1.0 for mid-range energies (e.g. 2–4 keV) disposed near the middle portion of spacer structure 102. Finally, the present embodiment has an exposed bare spacer structure 102 with a secondary electron emission coefficient function of at or near 1.0 for higher energies (e.g. 4–6 keV) disposed near anode 108. The present embodiment is also well suited to varying the location of, thickness of, or materials comprising the first and second coating to precisely tailor the resultant secondary electron emission coefficient function wherever desired along spacer assembly 400. Additionally, the present embodiment is also well suited to using more than two coating materials to achieve the desired resultant secondary electron emission coefficient function.

Figure 5:
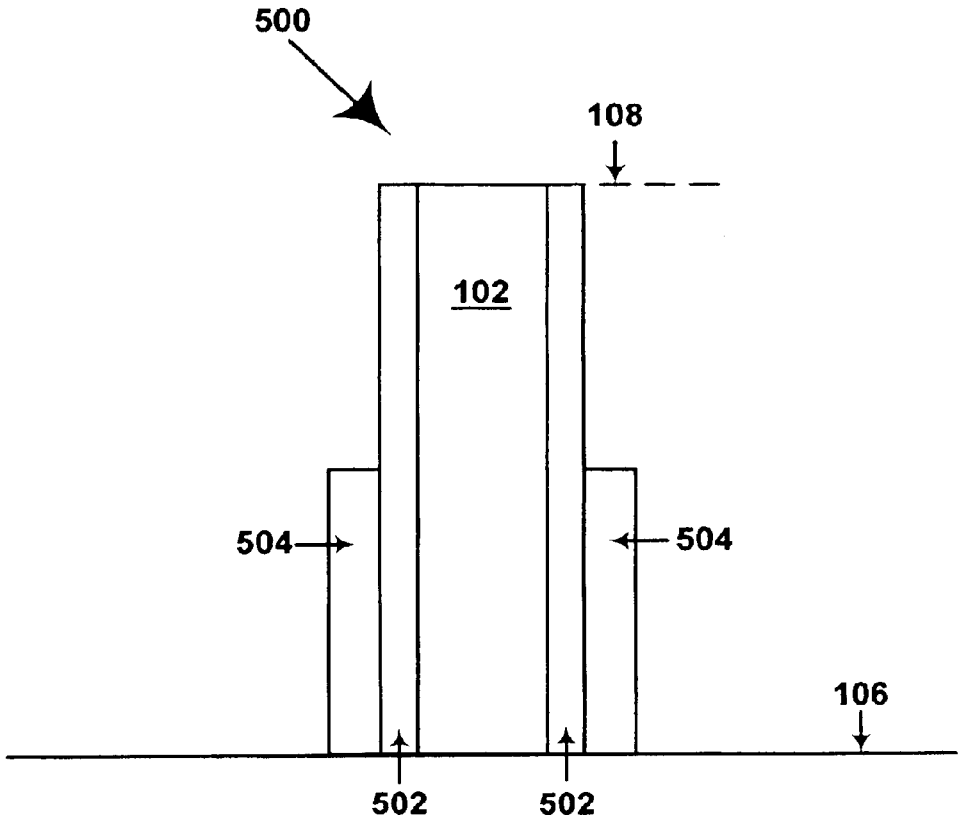
FIG. 5 is a side schematic view of a spacer assembly in which a spacer wall has a first coating material applied to a first portion thereof and a second coating material applied to a second portion thereof such that the entire spacer wall is coated in accordance with one embodiment of the present claimed invention.

With reference now to FIG. 5, a side schematic view of a spacer assembly 500 in which a spacer wall has a first coating material 502 applied to a first portion thereof and a second coating material 504 applied to a second portion thereof. In the embodiment of FIG. 5, the entire surface of spacer structure 102 is coated. In this embodiment, spacer structure 102 is comprised of the same materials described in detail above in conjunction with the embodiment of FIGS. 1, 2A, 3, and 4. However, the present invention is also well suited to spacer walls having various other compositions or component ratios. Additionally, in the present embodiment, second coating material 504 is comprised of $Cr_2O_3$, however, the present embodiment is also well suited to the use of various other coating materials. In the embodiment of FIG. 5, first coating material 502 is comprised of $Nd_2O_3$. As shown in FIG. 5, first coating material 502 is exposed only where impinging electrons will have an energy in the range of approximately 3–6 keV. Thus, by selecting a material (e.g. $Nd_2O_3$) which has a secondary electron emission coefficient function having a value of at or near 1.0 for such a potential range, the present embodiment tailors the overall secondary electron emission coefficient function to the desired value. That is, the present embodiment has a coating material 504 with a secondary electron emission coefficient function of at or near 1.0 for lower energies (e.g. 0–3 keV) disposed near cathode 106. The present embodiment then has a coating material 502 with a secondary electron emission coefficient function of at or near 1.0 for higher energies (e.g. 3–6 keV) disposed near anode 108. In this embodiment, none of bare spacer structure 102 is exposed. The present embodiment is also well suited to varying the location of, thickness of, or materials comprising the first and second coating to precisely tailor the resultant secondary electron emission coefficient function wherever desired along spacer assembly 500. Additionally, the present embodiment is also well suited to using more than two coating materials to achieve the desired resultant secondary electron emission coefficient function.

Figure 6:
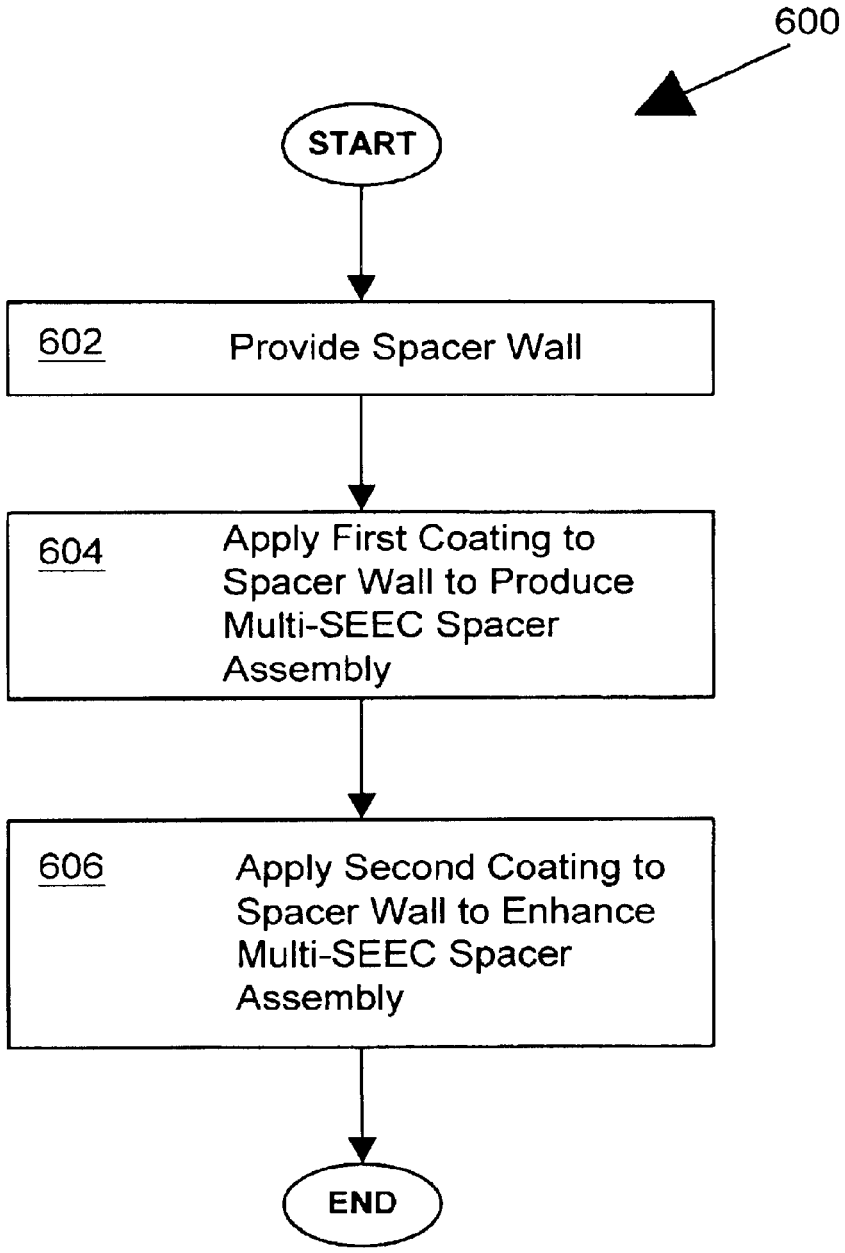
FIG. 6 is a flow chart of steps performed during the production of a spacer assembly in which a spacer wall has a first coating material applied to a first portion thereof and a second coating material applied to a second portion thereof in accordance with one embodiment of the present claimed invention.

With reference now to FIG. 6 a flow chart 600 of steps performed during the production of a spacer assembly in accordance with the present claimed invention is shown. As shown in FIG. 6, at step 602, the present invention first provides a spacer wall. In the present embodiment, the spacer wall (e.g. spacer structure 102 of FIG. 1, 2A, 3, 4, and 5) is comprised of a combination of materials. More specifically, in the present embodiment spacer structure 102 is comprised of approximately 30 percent chromium oxide ($Cr_2O_3$), approximately 70 percent alumina ($Al_2O_3$), with a small amount of titanium (Ti) added as well. Although spacer structure 102 is comprised of such a mixture in the present embodiment, the present invention is also well suited to spacer walls having various other compositions or component ratios. Typically, spacer structure 102 will have a length (from cathode to anode) of 1.25 millimeters, and a width of 50 mils.

Next, at step 604, the present embodiment applies a first coating material (e.g. coating material 104 of FIG. 1) to spacer wall provided in step 602. In one embodiment, the coating material is comprised of $Cr_2O_3$. Furthermore, in the present embodiment, the coating material is applied to the underlying spacer wall with approximately a few hundred Angstroms. It is within the scope of the present invention, however, to vary the thickness of the coating material. The present invention is also well suited to the use of various other coating materials which satisfy the conditions set forth above. Additionally, the present invention is well suited to varying the location on spacer structure 102 to which the coating material is applied. That is, the present invention is, for example, well suited to applying coating material proximate to where the spacer wall is coupled to a cathode of a field emission display device, and/or not applying the coating material proximate to where the spacer wall is coupled to an anode of a field emission display device.

Referring now to step 606, the present embodiment then applies a second coating material (e.g. coating material 404 of FIG. 4) to the spacer assembly. In one embodiment, the second coating material overlies a first coating material (e.g. coating material 402 of FIG. 4). In so doing, the present embodiment tailors the overall secondary electron emission coefficient function to a desired value. That is, the present embodiment has a coating material (e.g. the second coating material) with a secondary electron emission coefficient function of at or near 1.0 for lower energies (e.g. 0–3 keV) disposed near the cathode of the field emission display device.

The present embodiment then has another coating material (e.g. the first coating material) with a secondary electron emission coefficient function of at or near 1.0 for higher energies (e.g. 3–6 keV) disposed near the anode of the field emission display device. The present embodiment is also well suited to varying the location of, thickness of, composition of, or materials comprising the first and second coating to precisely tailor the resultant secondary electron emission coefficient function wherever desired along the spacer assembly.

Figure 7:
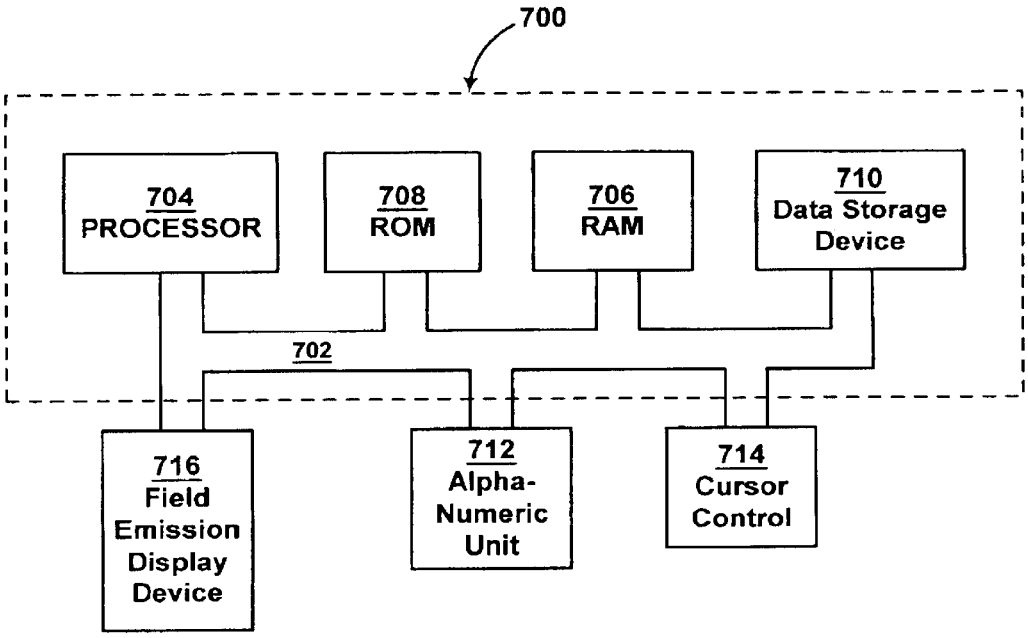
FIG. 7 is a schematic diagram of an exemplary computer system having a field emission display device in accordance with one embodiment of the present invention.

With reference now to FIG. 7, an exemplary computer system 700 used in accordance with the present embodiment is illustrated. It is appreciated that system 700 of FIG. 7 is exemplary only and that the present invention can operate within a number of different computer systems including personal computer systems, laptop computer systems, personal digital assistants, telephones (e.g. wireless cellular telephones), in-vehicle systems, general purpose networked computer systems, embedded computer systems, and stand alone computer systems. Furthermore, as will be described below in detail, the components of computer system 700 reside, for example, in a client computer and/or in the intermediate device coupled to computer system 700. Additionally, computer system 700 of FIG. 7 is well adapted having computer readable media such as, for example, a floppy disk, a compact disc, and the like coupled thereto. Such computer readable media is not shown coupled to computer system 700 in FIG. 7 for purposes of clarity.

System 700 of FIG. 7 includes an address/data bus 702 for communicating information, and a central processor unit 704 coupled to bus 702 for processing information and instructions. Central processor unit 704 may be, for example, an 80×86-family microprocessor or various other type of processing unit. System 700 also includes data storage features such as a computer usable volatile memory 706, e.g. random access memory (RAM), coupled to bus 702 for storing information and instructions for central processor unit 704, computer usable non-volatile memory 708, e.g. read only memory (ROM), coupled to bus 702 for storing static information and instructions for the central processor unit 704, and a data storage unit 710 (e.g., a magnetic or optical disk and disk drive) coupled to bus 702 for storing information and instructions. System 700 of the present invention also includes an optional alphanumeric input device 712 including alphanumeric and function keys is coupled to bus 702 for communicating information and command selections to central processor unit 704. System 700 also optionally includes a cursor control device 714 coupled to bus 702 for communicating user input information and command selections to central processor unit 704. System 700 of the present embodiment also includes an field emission display device 716 coupled to bus 702 for displaying information.

Referring still to FIG. 7, optional cursor control device 714 allows the computer user to dynamically signal the two dimensional movement of a visible symbol (cursor) on a display screen of display device 716. Many implementations of cursor control device 714 are known in the art including a trackball, mouse, touch pad, joystick or special keys on alphanumeric input device 712 capable of signaling movement of a given direction or manner of displacement. Alternatively, it will be appreciated that a cursor can be directed and/or activated via input from alphanumeric input device 712 using special keys and key sequence commands. The present invention is also well suited to directing a cursor by other means such as, for example, voice commands.

Figure 8:
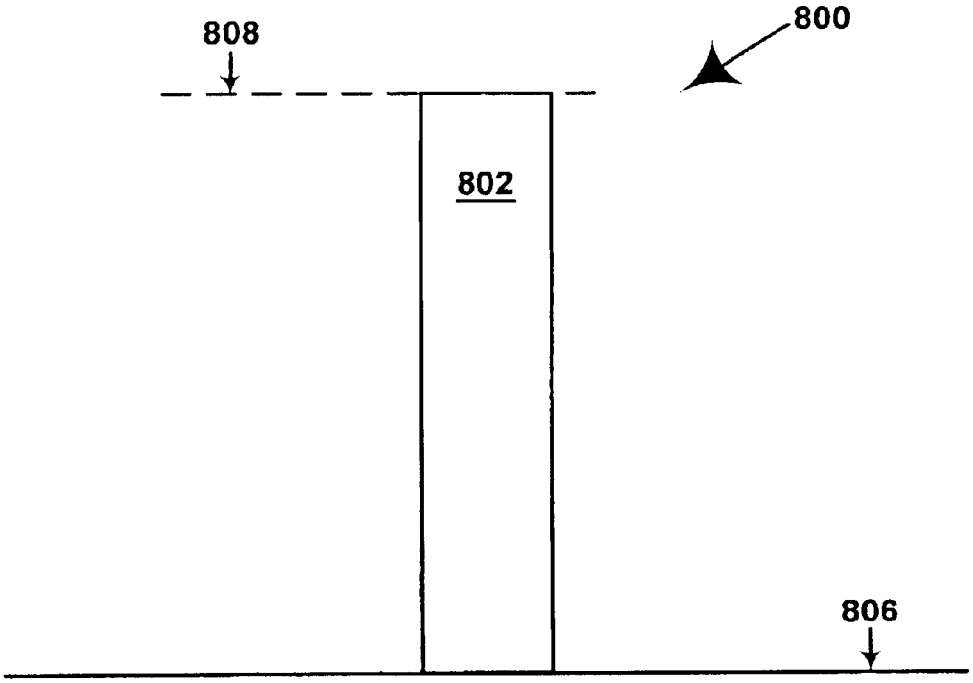
FIG. 8 is a side schematic view of a spacer assembly in which a support structure has a coating material applied thereto wherein the support structure is comprised of pure $Al_2O_3$ doped with cerium oxide in accordance with one embodiment of the present claimed invention.

With reference now to FIG. 8, a schematic side sectional view of a spacer assembly 800 in accordance with one embodiment of the present invention is shown. In the present embodiment, spacer assembly 800 is comprised of a spacer structure 802. Typically, spacer structure 802 will have a length (from cathode to anode) of approximately 1.25 millimeters, and a width of approximately 50 microns. Additionally, although portions of the following discussion may specifically mention spacer walls, it will be understood that the present invention is also well suited to use with various other support structures herein referred to as spacer structures including, but not limited to, posts, crosses, pins, wall segments, T-shaped objects, and the like. However, within the present application, the term spacer structure is intended to include, but not be limited to, the various types of support structures mentioned above. Furthermore, although the following discussion may specifically recite use of the various embodiments of the present invention in a field emission display device, the various embodiments of the present invention are well suited to use in various other flat panel display devices. Also, although embodiments of the present invention which refer to the use of a coating material may show the coating material applied to the entire portion of an underlying spacer structure, the present invention is well suited to various other configurations in which the coating material is applied to only specific portions of the underlying spacer structure.

Referring still to FIG. 8, the secondary electron emission coefficient of support structure 802 plays a critical part in achieving invisibility of the support structure, as charging on the wall can lead to beam deflection, resulting in non-activated phosphor on either side of the wall. To achieve no or very low charging the secondary electron emission coefficient of the wall material must be around one (1) for all range of field emission display operating voltages (e.g. 0.5 kV to 8 kV). In the present embodiment, support structure 802 contains cerium oxide. In one embodiment, the measured secondary electron emission coefficient of cerium oxide for field emission display operating voltage range of0.5 kV to 7 kV gives a secondary electron emission coefficient of approximately 0.75 to 1.77. More specifically, the spacer structure of the present embodiment is pure $Al_2O_3$ doped with cerium oxide. In such an embodiment, the spacer structure achieves fine smoothness and great strength. For example, spacer structure 802 of the present embodiment, has a hardness of between that of $Al_2O_3$ (on the Mohs scale, $Al_2O_3$ has a hardness of 7) and cerium oxide (on the Mohs scale, cerium oxide has a hardness of 6).

Figure 9:
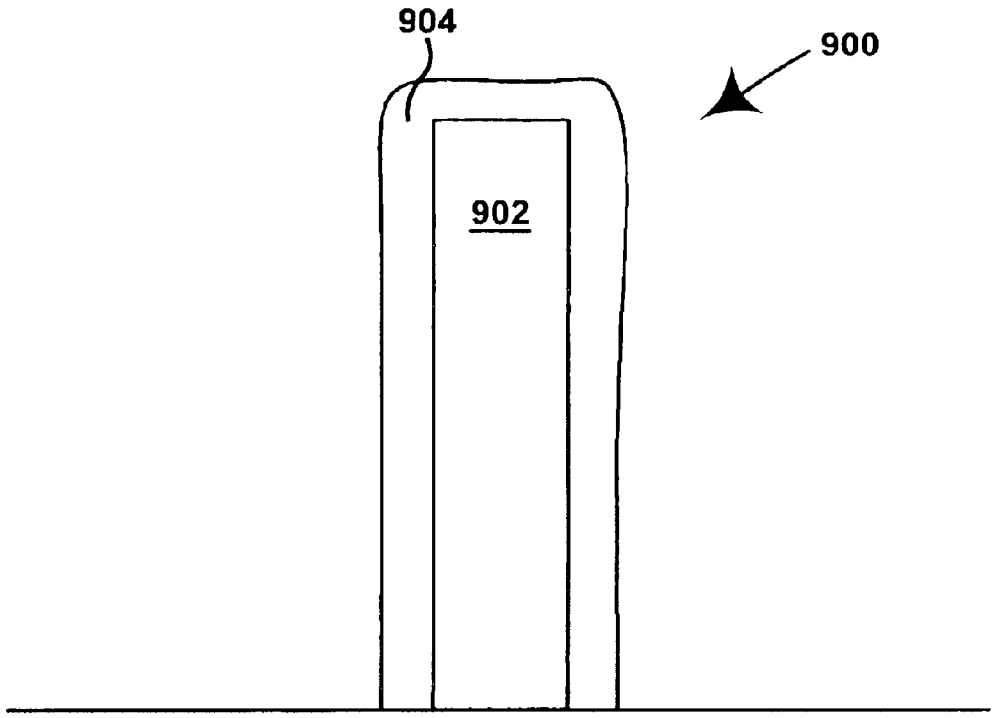
FIG. 9 is a side schematic view of a spacer assembly in which a support structure has a coating material applied thereto wherein the coating material is comprised of a layered material in accordance with one embodiment of the present claimed invention.

With reference now to FIG. 9, another embodiment 900 of the present invention is shown. In this embodiment, a spacer structure 902 has a coating material 904 applied to a portion thereof. In the present embodiment, coating material 904 is applied to spacer structure 902 with a thickness on the order of Angstroms. It is within the scope of the present invention, however, to vary the thickness of coating material 904. Additionally, although coating material 904 is applied to the entire portion of spacer structure 902 as shown in FIG. 9, the present invention is well suited to various other configurations in which coating material 904 is applied to only specific portions of spacer structure 902.

Referring still to FIG. 9, as mentioned above, it is desired to achieve a secondary electron emission coefficient of approximately 1 for the operating voltages of the flat panel display. The present embodiment provides a material which achieves relatively weak scattering of high energy incident or primary electrons and very strong scattering of lower energy secondary electrons. More particularly, in the present embodiment, coating material 904 is comprised of a layered material. In the present embodiment, the layered material is deposited with its basal planes parallel to the face of the ceramic support structure 902. In so doing, coating material 904 of the present embodiment achieves, a much reduced secondary electron emission coefficient (i.e. closer to the value of 1) than that of comparable materials with random orientations.

Figure 10:
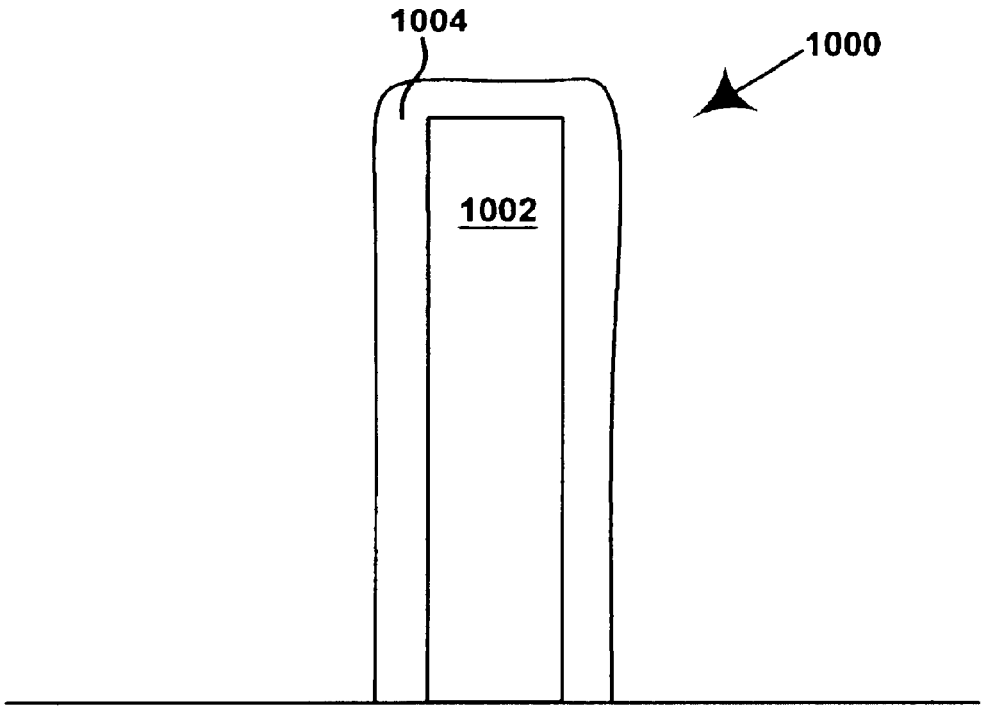
FIG. 10 is a side schematic view of a spacer assembly in which a support structure has a coating material applied thereto wherein the coating material is comprised of multi-component transition metal oxide material in accordance with one embodiment of the present claimed invention.

With reference still to FIG. 9, in one embodiment, the layered material comprising coating material 904 is a semi-metal. Moreover, in one specific embodiment, the layered material of coating material 904 is comprised a material such as graphite, $MoS_2$, $MoSe_2$, and the like, Referring now to FIG. 10, another embodiment 1000 of the present invention is shown. In the embodiment of FIG. 10, a support structure 1002 has a coating material 1004 disposed thereon. In this embodiment, coating material 1004 is comprised of a transition metal oxide compound. Such a coating material decreases the electron escape depth, lambda. Such a decrease in the electron escape depth, lambda, is accomplished by forming solid solutions in quaternary oxides whereby a random ordering is induced in either ion valence, unoccupied d-states in the conduction band, or in ionic radii. Hence, coating material 1004 of the present embodiment decreases wall visibility (i.e. increases invisibility). Additionally, coating material 1004 of the present embodiment meets the desired requisite properties of low secondary electron emission, high resistivity, high thermal stability, high stability under electron beam bombardment, and high resistance to hydrocarbon contamination. Furthermore, coating material 1004 reduces the secondary electron emission of support assembly 1000 without otherwise increasing the electrical conductively of support assembly 1000. Also, coating material 1004 achieves the above properties and does not degrade upon thermal treatments up to and including 500 degrees Centigrade. Coating material 1004 achieves the above properties and does not degrade upon prolonged exposure to electron flux during operation of the display. As yet another benefit, coating material 1004 of the present embodiment achieves the above properties and does not degrade when exposed to the types of gaseous chemicals that are typically encountered during the assembly and sealing processes typical of emissive displays.

Referring still to FIG. 10, coating material 1004 is comprised in one embodiment, of ternary and quaternary transition metal oxides. More specifically, in one embodiment, coating material 1004 has the perovskite composition: $ABO_3$, where A and B are transition metals. In another embodiment, coating material 1004 is comprised of, for instance, any of the lanthanide elements can be mixed together as a solution comprising the "A" atom position. (e.g. $(Nd_x, Pr_{1-x})\ TiO_3$). In still another embodiment, coating material 1004 is comprised of a $A_2BO_4$ composition such as, for example, $La_xBa_{(2-x)}CuO_4$, where A and B are transition metals. One of the unique and controllable properties of these coating materials lies in their ability to scatter internal secondary electrons, essentially trapping the secondaries by forcing them to lose their energy before escaping from the solid. Additionally, certain quaternary compositions can be found which will decrease the "escape length" lambda which is characteristic of this property. Hence, in one embodiment, coating material 1004 is comprised of a material in which atoms are mixed on the "A" site with alternating valence. An example would be $La_xBa_{(1-x)}TiO_3$. In this case the La and Ba would occupy similar lattice sites. The La will be a 3+ ion while the Ba will be a 2+ ion. The random nature of their local electrical fields will encourage electron scattering and reduce lambda.

Referring still to FIG. 10, in another embodiment, coating material 1004 is comprised of a material where metals of the same valence are mixed but where the materials have different energy unoccupied states in the band gap. An example would be $SrTi_xZr_{(1-x)}O_3$. In this embodiment, both Ti and Zr have the configuration 4+, but since they have unoccupied d-orbitals at different energies in the gap there is an effective "roughness" or randomness near the bottom of the conduction band which will facilitate electron scattering and reduce lambda.

Referring again to FIG. 10, is still another embodiment, coating material 1004 is comprised of a material in which atoms of different size are mixed on the same lattice site. In one such embodiment, coating material 1004 is comprised of $La_xY_{(1-x)}CrO_3$. In this embodiment, both La and Y will have the valence 3+ but will have significantly different ionic radii. The result is that the lattice exists in relative tension around the Y atoms while it exists in relative compression around the La atoms. As a result the band gap will have randomly varying energies which will facilitate electron scattering and reduce lambda.

Figure 11:
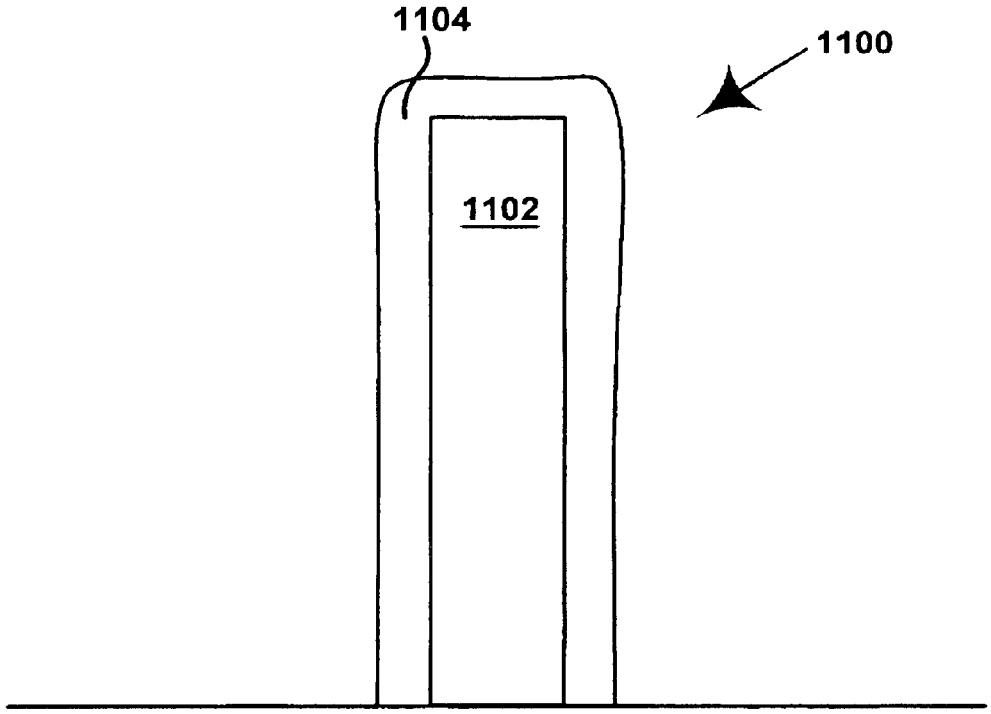
FIG. 11 is a side schematic view of a spacer assembly in which a support structure has a coating material applied thereto wherein the coating material is comprised of boron nitride material in accordance with one embodiment of the present claimed invention.

With reference now to FIG. 11, another embodiment 1100 of the present invention is shown. In the embodiment of FIG. 11, a coating material 1104 has the proper combination of electrical properties such that, when deposited on support structure 1102, charging will be minimized and support structure 1102 will be invisible. In the prior art, it has been found that carbon with a short range graphitic structure exhibits low secondary electron emission. However, the electrical conductively of graphite prohibits the use of thick coatings on the surface of support structures such as support structure 1102. In order to obtain sufficiently resistive coatings, carbon film thicknesses on the order of 15 Angstroms are needed. Thicknesses in this range are difficult to deposit in a reproducible manner. However, the boron nitride composition of the present embodiment is significantly less conducting then graphite and the present composite of boron nitride and carbon produces a coating with low secondary electron emission and sufficiently great resistivity to permit the use of much thicker layers. Hence, coating material 1104 of the present embodiment is well suited to having a thickness of greater than approximately 15 Angstroms.

Referring still to FIG. 11, coating material 1104 of the present embodiments utilizes boron nitride alone or in combination with carbon films to obtain a material with a crystal structure which produces low secondary electron emissions. In addition to this previously observed crystal structure, the present coating material 1104 of boron nitride alone or in combination with carbon has greater resistivity than carbon alone. As yet another advantage, coating material 1104 of the present embodiments (i.e. boron nitride alone or in combination with carbon films) shares many similar mechanical properties with graphite due to the similarity of their crystal structures.

Figure 12:
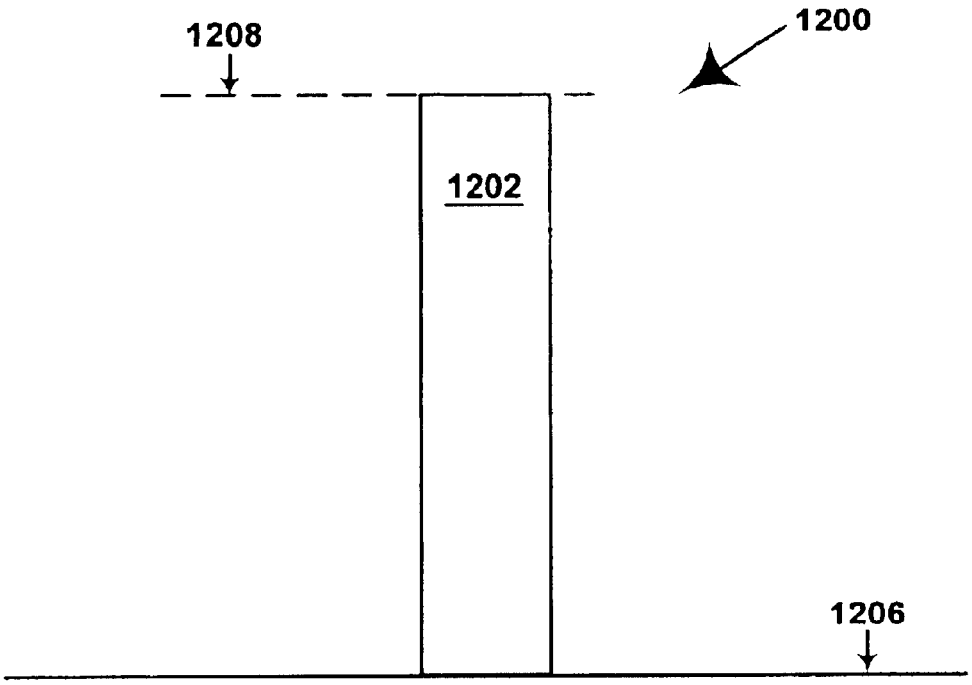
FIG. 12 is a side schematic view of a spacer assembly in which a support structure has a coating material applied thereto wherein the support structure is comprised of a material selected from the group consisting of borides, carbides, or nitrides in accordance with one embodiment of the present claimed invention.

With reference now to FIG. 12, another embodiment 1200 of the present invention is shown. In this embodiment, support structure 1202 is comprised of at least one of the following materials: borides, carbides or nitrides. In such an embodiment, the materials are formulated in bulk form (e.g. as a sintered ceramic body). These materials are specific compounds that have boron (B), carbon (C) or nitrogen (N) as one of the components in them. For example, BN corresponds to boron nitride. Several distinct advantages are realized by utilizing borides, carbides, or nitrides as the spacer structure in accordance with the present embodiments. For example, such materials are very strongly covalent in nature and hence have the following generic properties: (i) they are very hard and mechanically strong; (ii) they have very high melting points; (iii) they are generally very oxidation resistant; (iv) they have a large band gap and hence behave like wide bandgap semiconductors; and (v) they have very high intrinsic resistivities.

Figure 13:
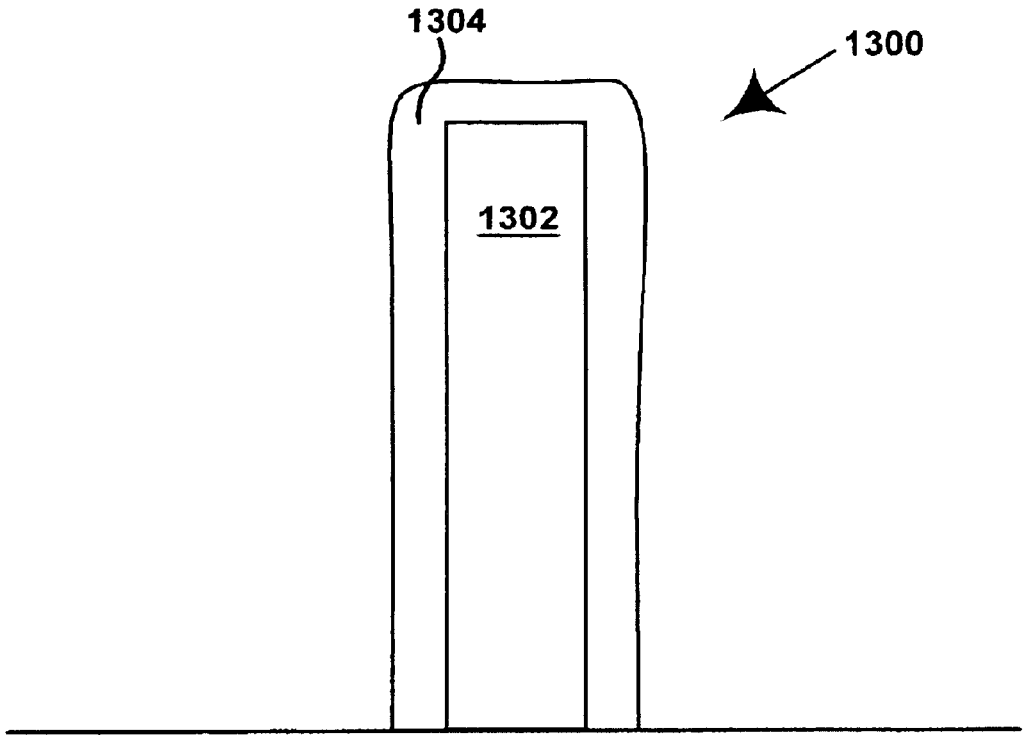
FIG. 13 is a side schematic view of a spacer assembly in which a support structure has a coating material applied thereto wherein the coating material is comprised of a material selected from the group consisting of borides, carbides, or nitrides in accordance with one embodiment of the present claimed invention.

With reference now to FIG. 13, another embodiment 1300 of the present invention is shown. In this embodiment, a support structure 1302 has a coating material 1304 applied thereto (In one embodiment, spacer structure 1302 is also comprised of at least one of the following materials: borides, carbides or nitrides). In the present embodiment, coating material 1304 is comprised of at least one of the following materials: borides, carbides or nitrides. In such an embodiment, the materials are formulated as a thin film.

These materials are specific compounds that have boron (B), carbon (C) or nitrogen (N) as one of the components in them. For example, BN corresponds to boron nitride. Several distinct advantages are realized by utilizing borides, carbides, or nitrides as the coating material in accordance with the present embodiments. For example, such materials are very strongly covalent in nature and hence have the following generic properties: (i) they are very hard and mechanically strong; (ii) they have very high melting points; (iii) they are generally very oxidation resistant; (iv) they have a large band gap and hence behave like wide bandgap semiconductors; and (v) they have very high intrinsic resistivities. Additionally, coating material 1304 of the present embodiment, is well suited to application to spacer structure 1302 using a variety of processes. These processes include, for example, pulsed laser ablation to deposit thin films of these materials. Furthermore, large areas can be coated using chemical vapor deposition, sputtering or even liquid state processing routes.

Figure 14:
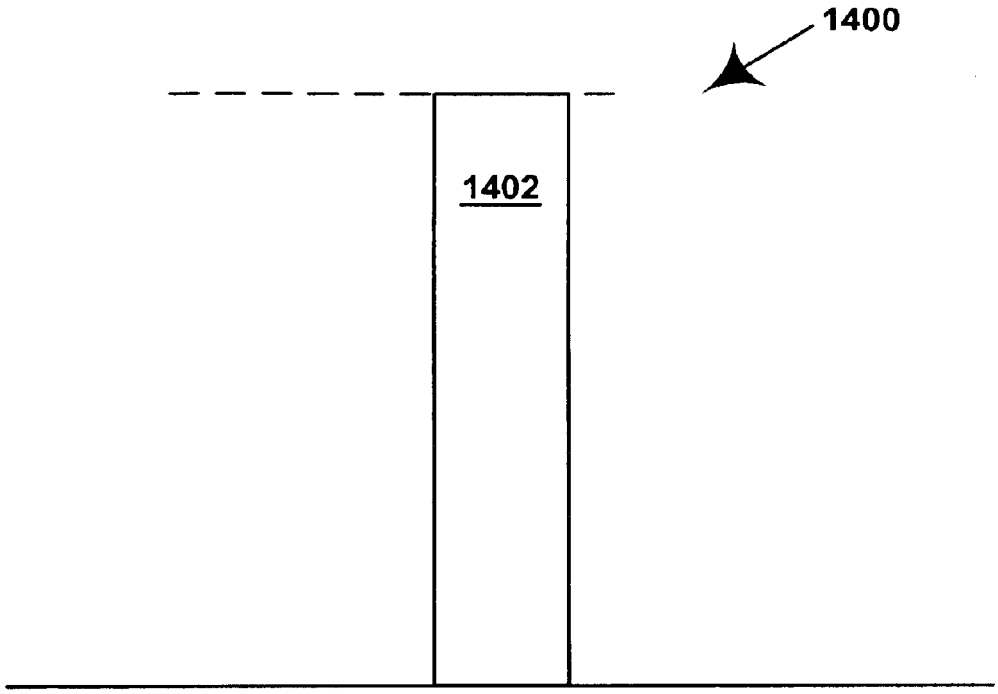
FIG. 14 is a side schematic view of a spacer assembly in which a support structure has a coating material applied thereto wherein the support structure is comprised of an oxygen releasing material in accordance with one embodiment of the present claimed invention.

With reference now to FIG. 14, another embodiment 1400 of the present invention is shown. In the present embodiment, spacer structure 1402 includes material which releases oxygen. Referring still to FIG. 14, in one embodiment, the oxygen releasing material of spacer structure 1402 is comprised of oxidizers such as perchlorates, peroxides, and nitrates. The key criteria for the chosen material are: 1) highly insulating both before and after releasing oxygen, but not so insulating as to prevent charge from passing from any coating material into spacer structure 1402; 2) stable through the seal cycle temperature (<400C); 3) somewhat unstable under electron bombardment; and 4) possible to deposit a thin (of order 100 Angstroms). layer of the material by sputtering.

More specifically, in one embodiment, spacer structure 1402 includes a perchlorate compound such as $KClO_4$ in the surface layers thereof. In so doing, the present embodiment prevents oxygen loss in the wall surface and eliminates surface contamination by oxidation. The oxygen releasing material of the present embodiment is stable through the seal process, but breaks down releasing oxygen gradually over the life of the tube under bombardment by Rutherford scattered electrons. As a specific example, $KClO_4$ is stable to 400° C.

Referring still to FIG. 14, in an embodiment in which spacer structure 1402 has a low SEEC coating material disposed thereon, the oxygen releasing material of the present embodiment is mixed within or placed under the coating material. In an embodiment in which spacer structure 1402 has no coating material disposed thereon, the oxygen releasing material is placed on the wall surface. The oxygen is preferably released mainly in the form of O ions and not $O^2$ gas.

One feature of the present embodiment, is the ability to replenish the lost oxygen in spacer structure 1402 and to produce excess oxygen to "burn" away (to CO or $CO_2$) carbon contamination on the spacer structure 1402. The CO and $CO_2$ gas products will be pumped away by the getter in the display device. Small amounts of excess $O_2$ can also be pumped away. Locally generating oxygen, as is accomplished in the present embodiment, is superior to putting oxygen in the background gas of the display device. Oxygen will be released locally in proportion to the amount of electron beam flux and roughly proportional to the "damage" (oxygen loss and carbonaceous layer formation) being done by the electron beam. The oxygen will be in a more reactive form as ions than as $O_2$ molecules which must be cracked at the surface of support structure 1402 before they can react with support structure 1402 or contamination. Large quantities of oxygen cannot be left in the background gas of the display device because it would cause deterioration of the field emitters and overload the getter reducing the pumping rate for other contaminants.

Figure 15:
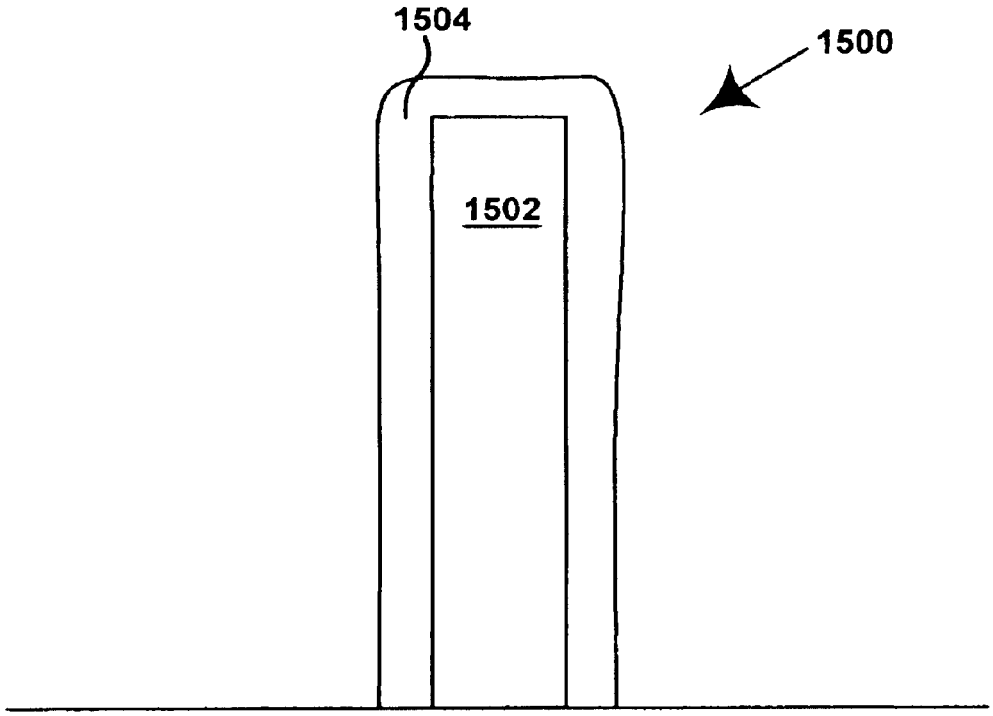
FIG. 15 is a side schematic view of a spacer assembly in which a support structure has a coating material applied thereto wherein the coating material is comprised of an oxygen releasing material in accordance with one embodiment of the present claimed invention.

With reference next to FIG. 15, another embodiment 1500 of the present invention is shown, In this embodiment, a spacer structure 1502 has a coating material 1504 applied thereto. In the present embodiment, coating material 1504 includes material which releases oxygen. In one embodiment, the oxygen releasing material of coating material 1504 is comprised of oxidizers such as perchlorates, peroxides, and nitrates. The key criteria for the chosen material are: 1) highly insulating both before and after releasing oxygen, but not so insulating as to prevent charge from passing from coating material 1504 into spacer structure 1502; 2) stable through the seal cycle temperature (<400C); 3) somewhat unstable under electron bombardment; and 4) possible to deposit a thin (of order 100 Angstroms) layer of the material by sputtering.

More specifically, in one embodiment, coating material 1504 includes a perchlorate compound such as $KClO_4$. In so doing, the present embodiment prevents oxygen loss in coating material 1504 and eliminates surface contamination by oxidation. The oxygen releasing material of the present embodiment is stable through the seal process, but breaks down releasing oxygen gradually over the life of the tube under bombardment by Rutherford scattered electrons. As a specific example, $KClO_4$ is stable to 400° C.

Referring still to FIG. 15, in this embodiment oxygen will preferably is released mainly in the form of O ions and not $O_2$ gas. In the present embodiment, the thickness of coating material 1504 should be chosen to be the minimum needed to release oxygen at a sufficient rate to prevent changes in the conductivity of the spacer assembly (e.g. an underlying spacer structure 1502 and coating material 1504) over the life of the display device.

Figure 16:
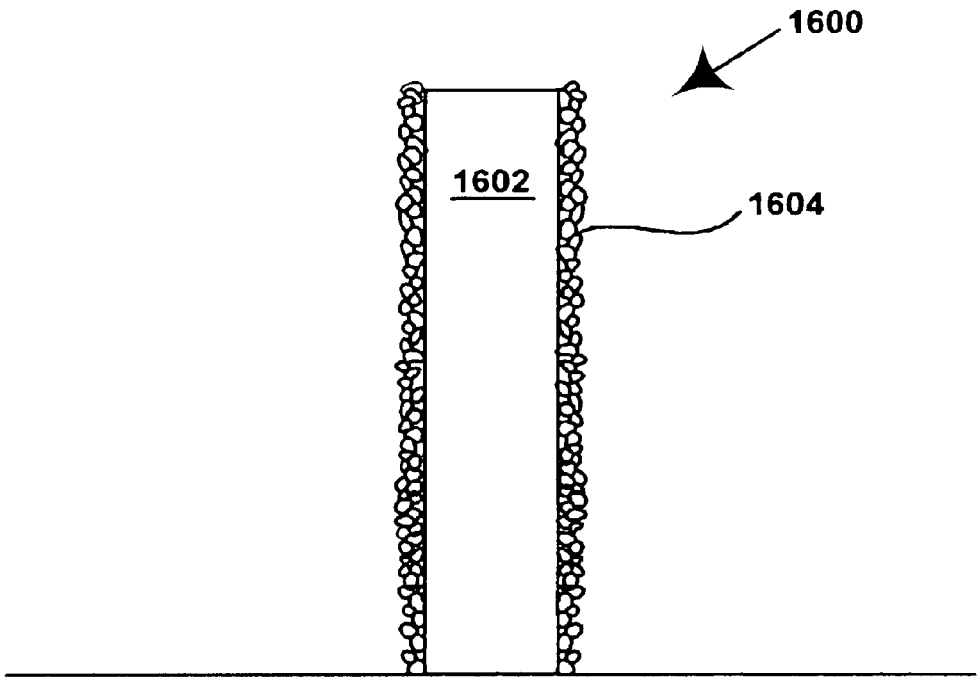
FIG. 16 is a side schematic view of a spacer assembly in which a support structure has a coating material applied thereto wherein the coating material is comprised of metal-containing particles in accordance with one embodiment of the present claimed invention.

With reference now to FIG. 16, another embodiment 1600 of the present invention is shown. In this embodiment, ceramic and other insulating spacer structers 1602 tend to have higher secondary electron emission coefficients (SEECs) than metal support structures due to the lack of "free electrons". The present embodiment lowers the SEEC of spacer assemblies which include insulating spacer structures (e.g. spacer structure 1602) by dispersing metal-containing particles, typically shown as 1604, on spacer structure 1602.

Figure 17:
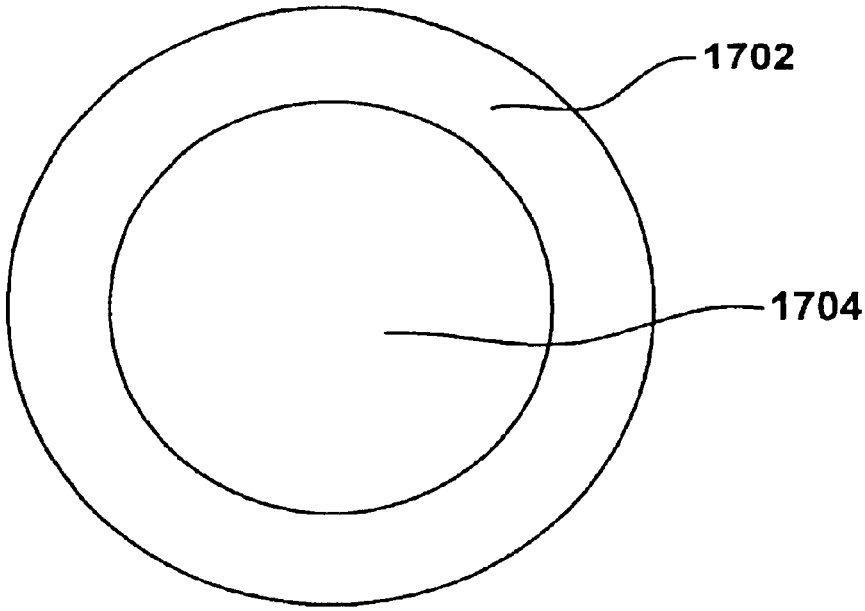
FIG. 17 is a cross sectional view of a metal-containing particle of FIG. 16 in accordance with one embodiment of the present claimed invention.

Referring now to FIG. 17, a side sectional view of metal-containing particle 1604 is shown. In the present embodiment, metal-containing particle 1604 is comprised of a core of metal material 1704 which is electrically isolated in an insulating shell 1702, thus the resistivity of spacer structure 1602 will not be significantly affected by the presence of metal-containing particles 1604 on spacer structure 1602. In one embodiment, core of metal material 1704 has a diameter of approximately 1,000–10,000 Angstroms through powder metallurgy. Furthermore, in one embodiment, insulating shell 1702 has a thickness of approximately 20–200 Angstroms.

There are at least two methods for making metal-containing particles 1604 of the present embodiment. In one embodiment, metal-containing particles 1604 are prepared by reacting metal powder in the form of a sphere with oxygen or nitrogen. The SEEC value of metal-containing particles 1604 will be that of insulating shell 1702 at low voltage (when the penetration depth of the electrons is less than the shell thickness). However, the SEEC value of metal-containing particles 1604 will approach that of metal core 1704 at high voltage (when the penetration depth of the electrons is greater than the shell thickness). The energy of the transition depends, therefore, on the shell thickness. Thus, in order to control the overall charging behavior of spacer structures coated with metal-containing particles it is necessary to control the shell thickness in the range of 20 to 200 Angstroms.

Referring still to FIG. 17, in one embodiment, metal core of material 1704 of metal-containing particle 1604 is formed of a material selected from the group consisting of Si, Al, Ti, Cr, Zr, La, Ce, Pr, Nd, Pm, Sm, Eu, Gd, Th, Dy, Ho, Er, Tm, Yb, and Lu. Insulating shell 1702 is formed by reacting metal core of material 1704 with oxygen for controlled times at controlled temperatures. In another embodiment, metal core of material 1704 of metal-containing particle 1604 is formed of a material selected from the group consisting of Si, Al, Ti, Cr, Zr, La, Ce, Pr, Nd, Pm, Sm, Eu, Gd, Th, Dy, Ho, Er, Tm, Yb, and Lu, and insulating shell 1702 is formed by reacting metal core of material 1704 with nitrogen for controlled times at controlled temperatures.

Figure 18:
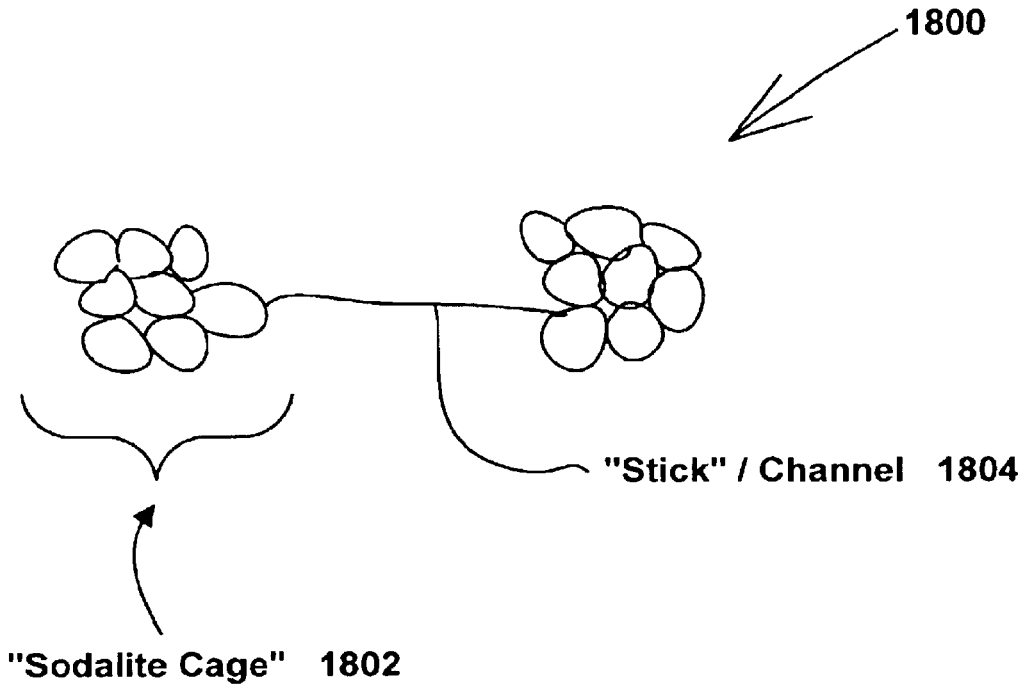
FIG. 18 is a cross sectional view of a zeolite-type metal-containing particle of FIG. 16 in accordance with one embodiment of the present claimed invention.

With reference now to FIG. 18, another embodiment of the metal-containing particles is shown. In this embodiment, "free electrons" are introduced by impregnating metal into a porous matrix, a good host structure would be that of a zeolite 1800 which is described as connected dumbbells. For example, in a typical, zeolite 1800 there is enough space to accommodate metal clusters (1–8 atoms) in the head of the dumbbell (so-called Sodalite Cage 1802) but no space for metal atoms in the stick of the dumbbells (the channels 1804). This structure 1800 allows for the introduction of isolated metal clusters into an insulating host.

Additionally, the present embodiment, is well suited to using various means to apply metal-containing particles 1604 to support structure 1602. For example, metal-containing particles 1604 can be coated to support structure 1602 by employing dip-coating or spray techniques. If a dense aggregation of metal-containing particles 1604 is desired, metal-containing particles 1604 are suspended in a colloidal solution and made to adhere to support structure 1602 and to each other by controlling the drying process. The process requires design of a "sol" that stabilizes surface energy between the shell of metal-containing particles 1604 and the solution. A secondary advantage of this technique is that a dense aggregation of metal-containing particles 1604 constitutes a "porous coating" and gains additional reductions in secondary emission (SEEC) due to its morphology.

Furthermore, in an embodiment where one is concerned about current arcing from one metal-containing particle 1604 to another metal-containing particle 1604 (i.e. tunneling currents through the insulating shell are substantial), a coating is employed where metal-containing particles 1604 on average do not touch each other. In such an embodiment, metal-containing particles 1604 are deposited at a density where the average spacing is slightly larger than the diameter of metal-containing particles 1604. It is possible to achieve a dense coating (>50 percent areal coverage by metal-containing particles 1604) and still prevent the clustering or aggregation of metal-containing particles 1604 by means of an electrophoresis technique. In this case the "sol" from which the coatings are derived maintains an electrical charge on each of the metal-containing particles 1604 causing them to deposit as an ordered or well-spaced array instead of a random or clustered array.

Figure 19:
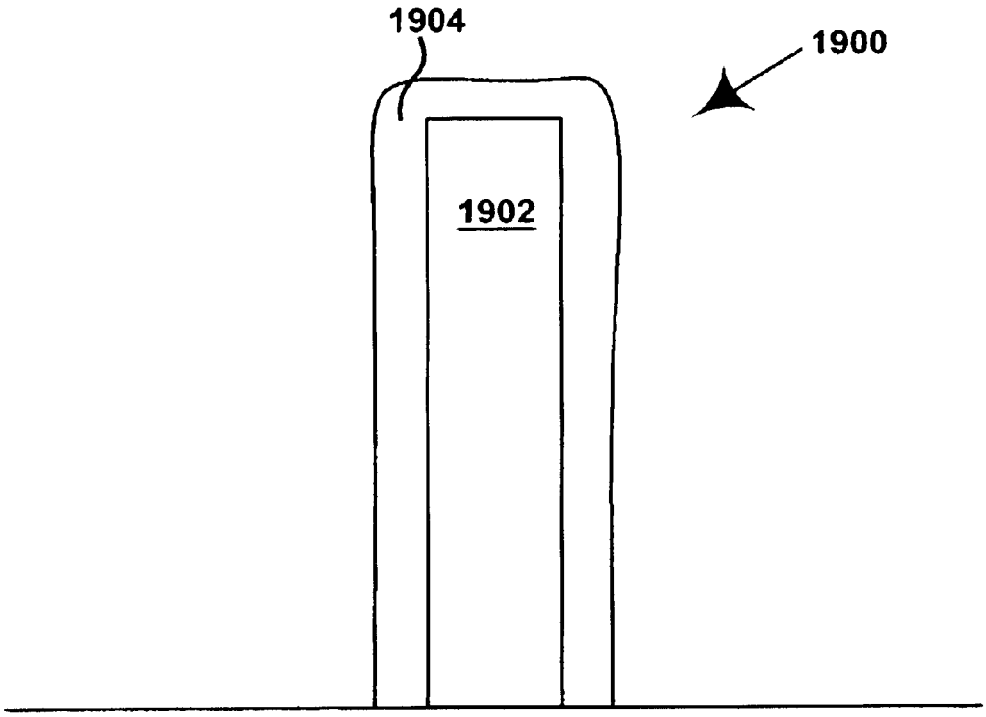
FIG. 19 is a side schematic view of a spacer assembly in which a support structure has a coating material applied thereto wherein the coating material is comprised of cerium oxide doped with lanthanides in accordance with one embodiment of the present claimed invention.

With reference now to FIG. 19, another embodiment 1900 of the present invention is shown. $CeO_2$ is known to lose oxygen upon anneal in vacuum or reducing atmospheres. Additionally, electron bombardment of $CeO_2$ coated support structures at temperatures below 100 C also leads to oxygen loss and significant reductions in resistivity of the support structures.

In the present embodiment, $CeO_2$ is doped to increase the resistivity of $CeO_2$ and the doped $CeO_2$ is then used as a coating material. In particular, in one embodiment, the $CeO_2$ is doped with lanthanide ions (Y, La, etc.) and the material is used as a coating material 1904 for an underlying support structure 1902. The lanthanide ions (Y, La, etc.) will quench all electronic conductivity in $CeO_2$ leaving only ions (metal substitutional anions and oxygen vacancy cations) as charge carriers.

Referring still to the embodiment of FIG. 19, because the lanthanide ions in coating material 1904 compensate for all the electronic charge carriers, the resistivity will no longer be sensitive to oxygen stoichiometry, oxygen vacancy concentrations, and/or oxygen partial pressures. Hence, the present embodiment provides a more-stable support structure coating material 1904.

In the another embodiment, the $CeO_2$ is doped with Cr and the material is used as a coating material 1904 for an underlying support structure 1902. The Cr will completely quench all electronic conductivity in $CeO_2$ leaving only ions (metal substitutional anions and oxygen vacancy cations) as charge carriers. Furthermore, in this embodiment, because the Cr ions in coating material 1904 compensate for all the electronic charge carriers, the resistivity will no longer be sensitive to oxygen stoichiometry, oxygen vacancy concentrations, and/or oxygen partial pressures. Hence, the present embodiment provides a more-stable support structure coating material 1904.

In the another embodiment, the $CeO_2$ is doped with Ni and the material is used as a coating material 1904 for an underlying support structure 1902. The Ni will completely quench all electronic conductivity in $CeO_2$ leaving only ions (metal substitutional anions and oxygen vacancy cations) as charge carriers. Furthermore, in this embodiment, because the Ni ions in coating material 1904 compensate for all the electronic charge carriers, the resistivity will no longer be sensitive to oxygen stoichiometry, oxygen vacancy concentrations, and/or oxygen partial pressures. Hence, the present embodiment provides a more-stable support structure coating material 1904.

Figure 20:
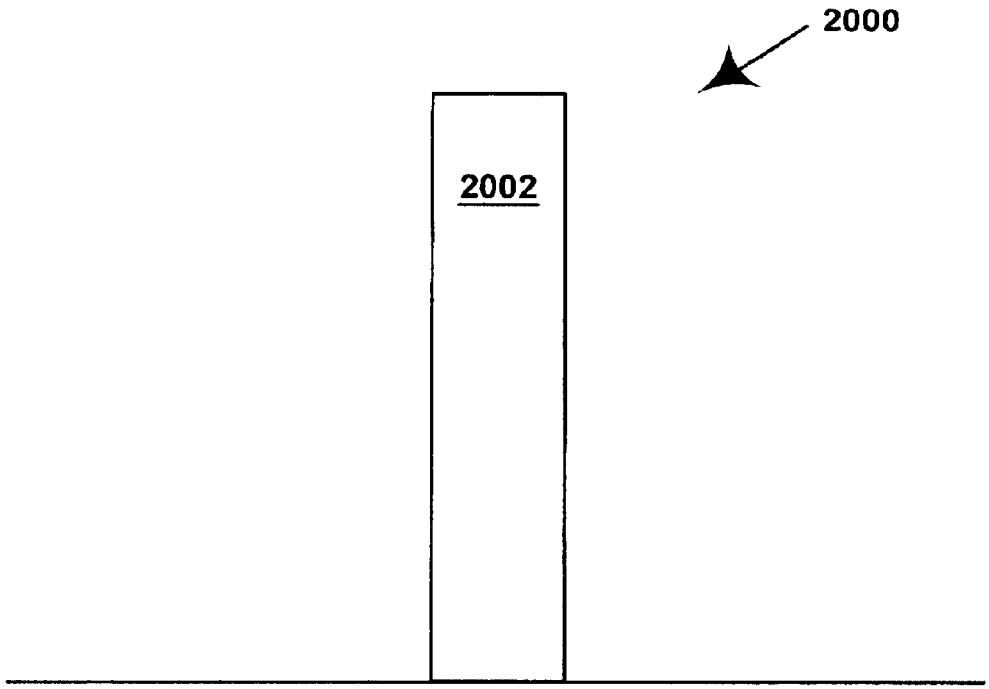
FIG. 20 is a side schematic view of a spacer assembly in which a support structure is comprised of a material selected according to a selection criteria which considers the free energy of formation of the material in accordance with one embodiment of the present claimed invention.

Referring now to FIG. 20, another embodiment 2000 of the present invention is shown. In the present embodiment, a selection criteria is provided for the bulk material of spacer structure 2002 based on the free energy of formation ($\Delta G$). The more negative the free energy of formation is, the more stable is the material system. As a corollary, material degradation of spacer structure 2002 will increase with an increase in $\Delta G$. Furthermore, thermal annealing is known to improve the stability of spacer structure 2002. Even if the material for support structure 2002 is thermodynamically stable (based on data for the crystalline materials taken from CRC Handbook), other factors such as kinetic, temperature, affinity to hydrocarbon, high electric field, electron beam bombardment and the deviation from crystallinity of the material can aggravate the degradation mechanism to different extents.

In the present embodiment, the selection criteria for support structure 2002 is based on its stability. If the choice passes this first principle criteria, then the selection criteria for support structure 2002 is based on the electrical resistivity, temperature coefficient of resistance (TCR), thermal conductivity (k), SEEC etc. The analysis presented here, applies to single oxide and non-oxide materials. However, the invention of the present embodiment is also applicable to binary and higher systems.

Figure 21:
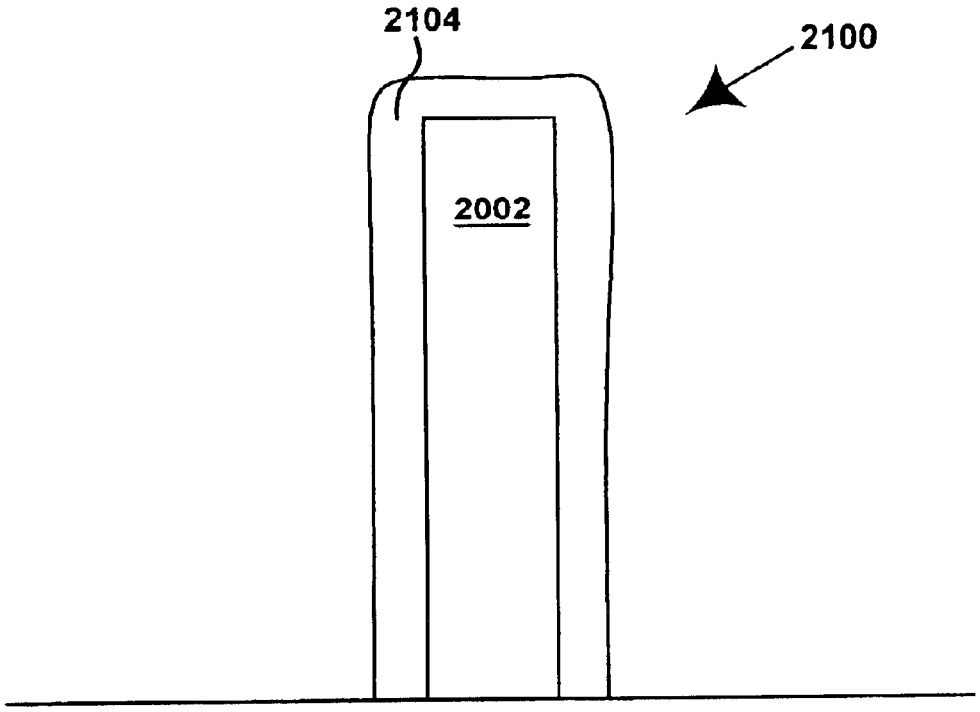
FIG. 21 is a side schematic view of a spacer assembly in which a support structure has a coating material disposed thereon and wherein the coating material is comprised of a material selected according to a selection criteria which considers the free energy of formation of the material in accordance with one embodiment of the present claimed invention.

Referring now to FIG. 21, another embodiment 2100 of the present invention is shown. In the present embodiment, a selection criteria is provided for the coating material 2104 overlying spacer structure 2002 based on the free energy of formation (ΔG). The more negative the free energy of formation is, the more stable is the material system. As a corollary, material degradation of coating material 2104 will increase with an increase in ΔG. Furthermore, thermal annealing is known to improve the stability of coating material 2104. Even if the material for coating material 2104 is thermodynamically stable (based on data for the crystalline materials taken from CRC Handbook), other factors such as kinetic, temperature, affinity to hydrocarbon, high electric field, electron beam bombardment and the deviation from crystallinity of the material can aggravate the degradation mechanism to different extents.

In the present embodiment, the selection criteria for coating material 2104 is based on its stability. If the choice passes this first principle criteria, then the selection criteria for coating material 2104 is based on the electrical resistivity, temperature coefficient of resistance (TCR), thermal conductivity (k), SEEC etc. The analysis presented here, applies to single oxide and non-oxide materials. However, the invention of the present embodiment is also applicable to binary and higher systems.

While thermal annealing may partially improve stability (through partial crystallization), bulk material processing (sintering) at temperatures higher than annealing temperature can be a better approach to form a spacer structure and overlying coating material at the same time.

Figure 22:
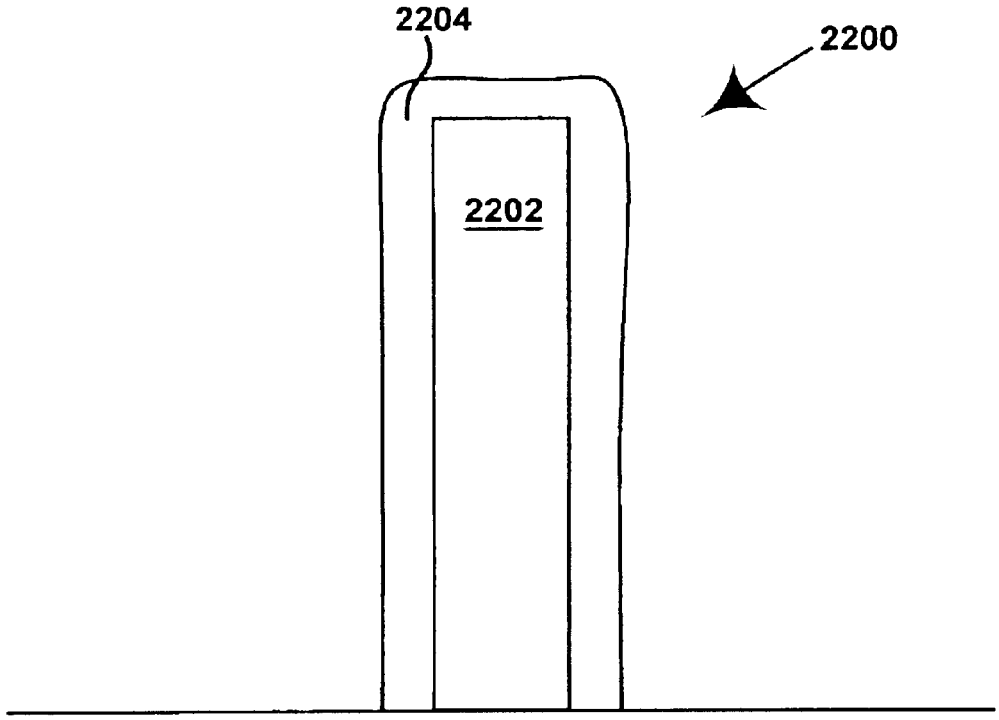
FIG. 22 is a side schematic view of a spacer assembly in which a support structure has a coating material disposed thereon and wherein the coating material is comprised of TiAlN in accordance with one embodiment of the present claimed invention.

With reference now to FIG. 22, another embodiment 2200 of the present invention is shown. The present embodiment pertains to the control of the resistivities of spacer assemblies by using coating materials 2204 such as borides, carbides and nitrides by deposition of a thin coating of TiAlN (or (Ti, Al)N and other materials) which are disposed over an underlying support structure 2202. The relative molar concentrations of the base material, i.e., borides, carbides and nitrides with TiAlN determines the effective resistivity of the mixture.

Referring still to FIG. 22, boron nitride has many attractive features such as high resistivity, mechanical strength, the ability to maintain its structural and chemical integrity at elevated temperatures and excellent oxidation resistance. In terms of its use as a support structure, it has desirable secondary electron emission properties. For example, the SEEC value at 1 KeV is of the order of 1.8, which is either commensurate or lower than that of the conventionally used support structure material. However, it has been determined that the resistivity of the thin film of boron nitride is $10^{12}$ Ω.cm or higher and hence, larger than that desirable for such applications. The present embodiment describes a efficient and manufacturable method to systematically control the resistivity of boron nitride, while maintaining its low SEEC value.

Referring again to FIG. 22, in one embodiment, a thin layer of N or (Ti, Al)N is deposited onto the surface of a boron nitride layer that is deposited onto the surface of support structure 2202. In another embodiment, a thin layer of (Ti, Al)N is deposited onto the surface of a boron nitride layer that is deposited onto the surface of support structure 2202. The deposition of the present embodiment is carried out in the presence of $N_2$ at a partial pressure in the range 20–100 mTorr. TiN and (Ti, Al)N are both metallic with resistivities of the order of 50–100 μΩ.cm at room temperature. This thin layer thickness can vary from 10–300 A, while the underlying boron nitride layer thickness can vary from 50–2000 A. Although such dimensions are recited in the present embodiment, the present invention is well suited to using various other dimensional parameters.

Referring still to FIG. 22, subsequent to this deposition step, the whole composite stack is annealed at an elevated temperature to facilitate chemical diffusion. The annealing temperature is in the range of 500–900° C. and is carried out in a $N_2$ atmosphere. Since the chemical and possibly structural nature of boron nitride and titanium nitride are very similar, interdiffusion occurs, as is confirmed by Rutherford backscattering spectroscopy experiments. As a consequence of this diffusion, the titanium atoms replace some of the boron nitride atoms. However, titanium is generally tetravalent while boron is trivalent. This difference in electronic structure between titanium and boron is the primary mechanism by which the resistivity is systematically altered. The extra electron available in this alloyed layer provides a route for electronic transport to occur, thereby reducing the resistivity. Further systematic alterations can be made over either a smaller range of resistivity or a larger range through careful tuning of the amount of TiN that is alloyed into the boron nitride.

In yet another embodiment, coating material 2204 is prepared as a multilayer of TiN and BN rather than as a alloy of these two materials.

In still another embodiment, support structure 2202 is itself made up of ceramic boron nitride and the surface of this support structure 2202 is coated with a thin layer of titanium nitride, coating material 2204. This TiN layer is then annealed at elevated temperature to diffuse the TiN into the BN layer and therefore create a surface layer of lower resistivity. For example, the resistivity of the surface can be altered from the high bulk value of $10^{12}$ Ωcm to a lower value, depending on the thickness and annealing temperature of the TiN surface layer. Both the materials used in this approach are available as low cost and in high purity. This approach is very easily manufacturable.

Figure 23:
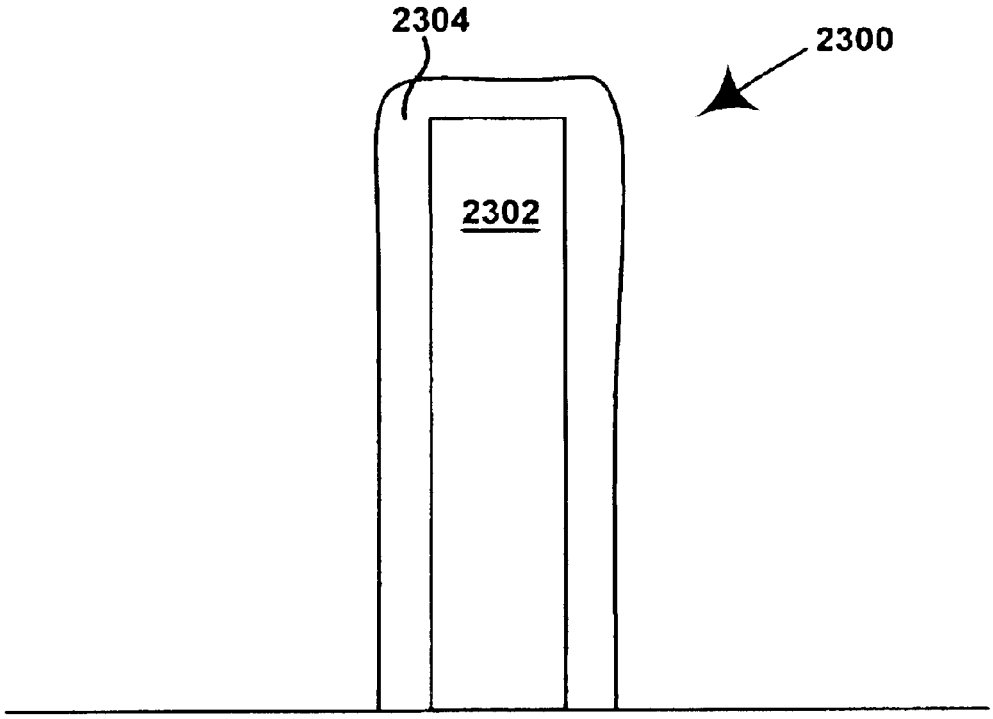
FIG. 23 is a side schematic view of a spacer assembly in which a support structure has a coating material disposed thereon and wherein the coating material is comprised of $Nd_2O_3$ in accordance with one embodiment of the present claimed invention.

With reference next to FIG. 23, another embodiment 2300 of the present invention is shown. In the present embodiment, an underlying support structure 2302 has a coating material 2304 disposed thereon wherein the coating material is comprised of $Nd_2O_3$. $Nd_2O_3$ has a combination of properties that allow this material to be used as insulating components or surface coatings for reducing secondary electron emission in vacuum electronics applications. The maximum SEEC is 1.8. The resistivity is greater than $5.0\times10^{10}$ ohm-cm and remains very high under electron dose of 1 C/cm2 at 1.5 kV. Furthermore, the $Nd_2O_3$ coating material 2304 of the present embodiment has a low SEEC, single-valance at 1 atm and chemical stability (little reaction with moisture and no oxygen loss at 1100 C in H2).

Figure 24:
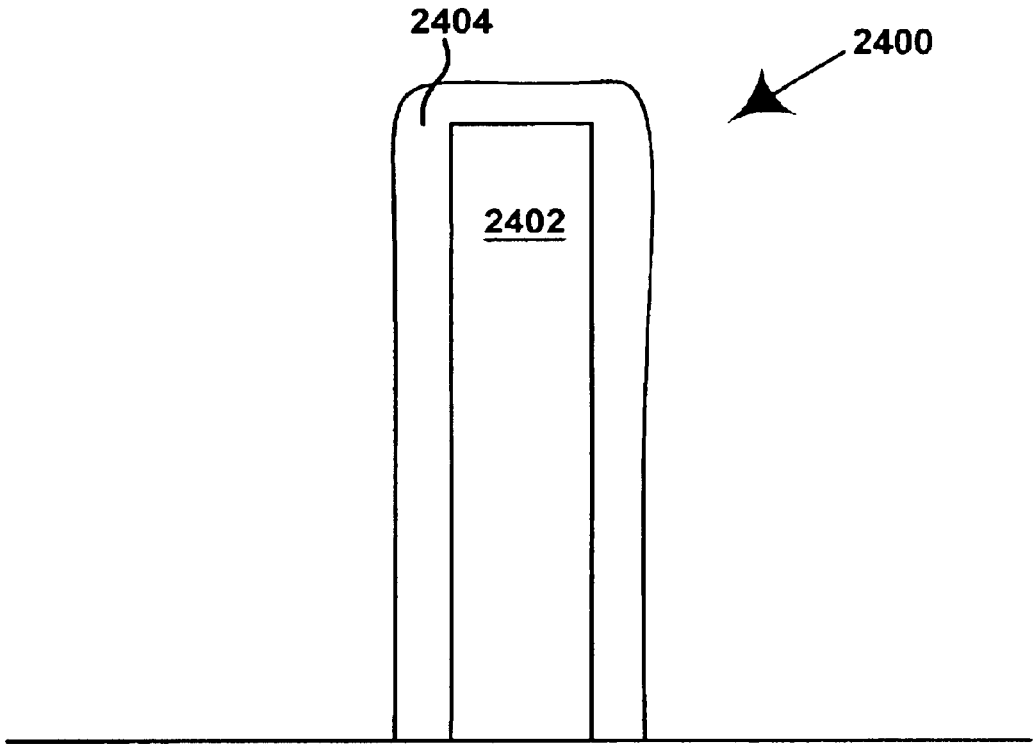
FIG. 24 is a side schematic view of a spacer assembly in which a support structure has a coating material applied thereto wherein the coating material is comprised of a material selected from the group consisting of $Cr_2O_3$-$Nd_2O_3$, $Nd_2O_3$-MnO, or $Cr_2O_3$-MnO in accordance with one embodiment of the present claimed invention.

Referring now to FIG. 24, another embodiment 2400 of the present invention is shown. The present embodiment expands coating materials from binary to ternary to improve performance in SEEC, resistivity and e-beam stability. More specifically, in the present embodiment, support structure 2402 has a coating material 2404 disposed thereon wherein the coating material is selected from the ternary systems consisting of $Cr_2O_3$-$Nd_2O_3$, $Nd_2O_3$-MnO, and $Cr_2O_3$-MnO. The ternary oxides of the present embodiment allow us to exploit structural and alloying effects for reducing SEEC, to optimize resistivity, and to reduce hydrocarbon sticking to the support structure 2402.

Figure 25:
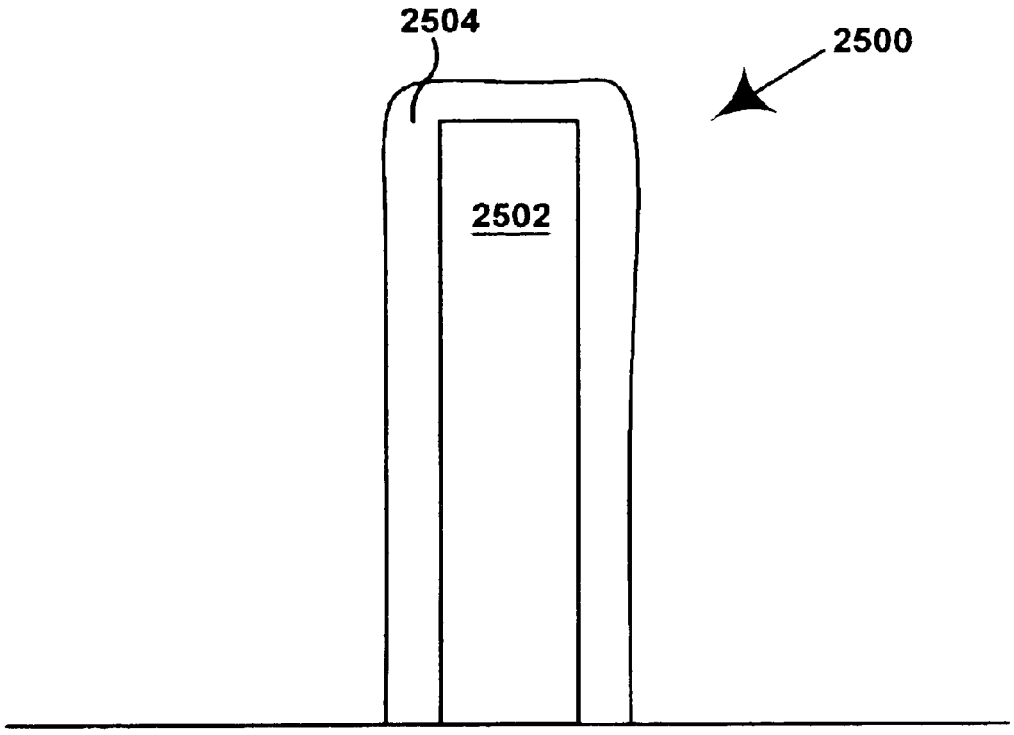
FIG. 25 is a side schematic view of a spacer assembly in which a support structure has a coating material applied thereto wherein the coating material is comprised of a material selected from the group consisting of $MoS_2$ and $WS_2$ in accordance with one embodiment of the present claimed invention.

Referring now to FIG. 25, another embodiment 2500 of the present invention is shown. In the present embodiment, support structure 2502 has a coating material 2504 disposed thereon. In this embodiment, coating material 2504 is comprised of a metal sulfide. More particularly, in one embodiment, coating material 2504 is comprised of a metal sulfide selected from the group consisting of $MoS_2$ and $WS_2$.

Coating material 2504 of the present embodiment has SEEC as low as metals (delta max around 1). In this embodiment, metal sulfides are used as surface coatings for reducing secondary electron emission in vacuum electronics. Furthermore, in one embodiment, the metal sulfide coatings are created by reacting oxide coatings with $H_2S$ and $H_2$ mixtures.

Figure 26:
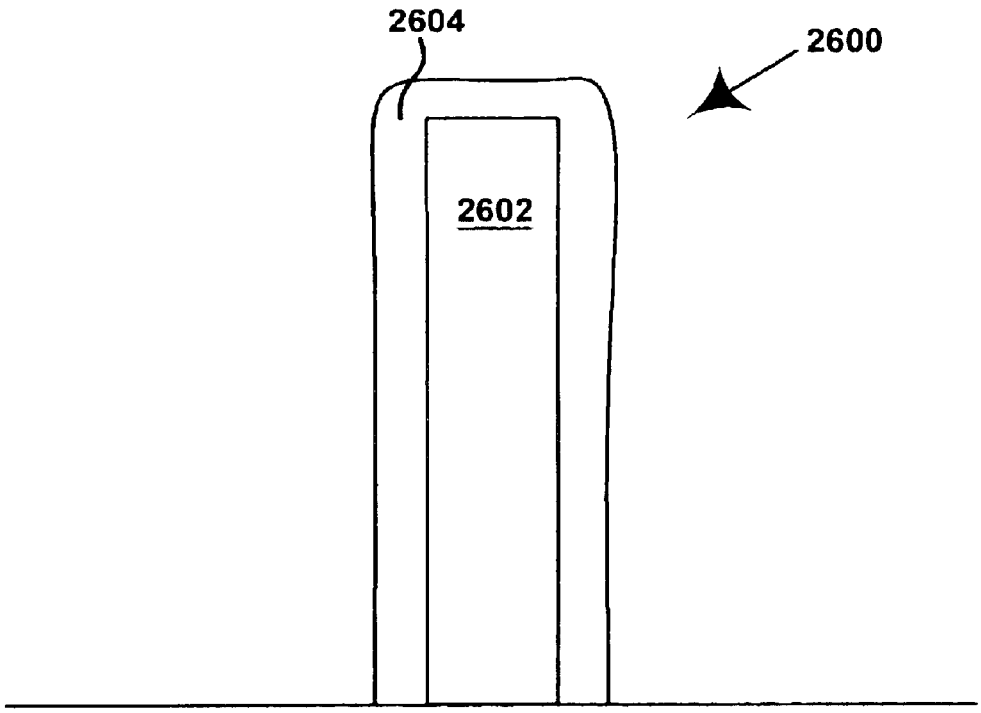
FIG. 26 is a side schematic view of a spacer assembly in which a support structure has a coating material applied thereto wherein the coating material is comprised of double layered material in accordance with one embodiment of the present claimed invention.

With reference now to FIG. 26, another embodiment 2600 of the present invention is shown. In this embodiment, support structure 2602 has a double layer coating material 2604 disposed thereon. In this embodiment, a double layer coating is comprised of a first layer A and a second layer B, wherein A and B have different electron densities such as $Cr_2O_3$ and $Nd_2O_3$. By choosing properly the thickness of A and B, the present embodiment achieves a SEEC of a multilayer coating which is lower than that of the individual coating, A or B. The multilayer coatings of the present embodiment are designed under several principles, for example, coating material 2604 of one embodiment is made with a structure similar to optical coatings for reducing light reflection from lens. Here, light reflected at the interfaces of the multilayer coatings interferes in a destructive manner. As a result, little light (electrons) is reflected (emitted) from the lens (support structure 2602); (b) the multilayer coatings are made in such a way that they are more transparent to high-energy incident electrons than to low-energy secondary electrons. In this case, the coating behaves like a one-way glass, and the multiple interfaces with abrupt change in electron density can enhance the scattering of electrons leading to reduction in the escape length of secondary electrons and a lower SEEC.

Referring still to FIG. 26, in one embodiment, coating material 2604 is comprised of a double layer of $Cr_2O_3$ on $Nd_2O_3$. $Cr_2O_3$ is not sticky to hydrocarbon but is too conducting when the coating is thicker than 100 A. On the other hand, $Nd_2O_3$ meets the resistivity requirement, but is too sticky to hydrocarbon and water. Therefore, in the present embodiment, a thin layer of $Cr_2O_3$ (e.g. approximately 30 Angstroms) is coated onto a relatively thick $Nd_2O_3$ coating (e.g. approximately 100 Angstroms). As a result, the present embodiment, provides a coating that is more resistive, less sticky to hydrocarbons, and better moisture-resistant. Furthermore, the present embodiment, the total thickness of the double coating 2604 is sufficiently high to achieve the full benefit of a charging-reduction coating.

As yet another advantage of the above-described embodiments, the spacer assemblies have good stability. That is, in addition to tailoring the secondary electron emission coefficient function to a value of near 1.0 along the entire length thereof, the spacer assemblies do not degrade severely when subjected to electron bombardment. By not degrading, the spacer assemblies do not significantly contribute to contamination of the vacuum environment of the field emission display device. Additionally, the many of the materials comprising the various spacer assemblies of the above embodiments can easily have contaminant carbon removed or washed therefrom prior to field emission display sealing processes. Also, many of the materials comprising the various spacer assemblies of the present embodiments do not deleteriously collect carbon after the field emission display seal process. As a result, many of the present embodiments are not subject to carbon-related contamination effects.

Thus, the present invention provides a spacer assembly which is tailored to provide a secondary electron emmission coefficient of approximately 1 for the spacer assembly when the spacer assembly is subjected to flat panel display operating voltages. The present invention further provides a spacer assembly which accomplishes the above achievement and which does not degrade severely when subjected to electron bombardment. The present invention further provides a spacer assembly which accomplishes both of the above-listed achievements and which does not significantly contribute to contamination of the vacuum environment of the flat panel display or be susceptible to contamination that may evolve within the tube.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A flat panel display apparatus comprising:

a faceplate;

a backplate disposed opposing said faceplate, said faceplate and said backplate adapted to be connected in a sealed environment such that a low pressure region exists between said faceplate and said backplate; and a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure;

wherein said spacer structure is comprised of alumina doped with cerium oxide.

2. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layered material that is oriented with its basal plane parallel to a face of said spacer structure.

3. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a metal oxide having the composition $ABO_3$, where A and B are transition metals.

4. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a metal oxide having the composition $A_2BO_4$, where A and B are transition metals.

5. The flat panel display apparatus of claim 3 wherein said transitional metals A and B are mixed with alternating valence.

6. The flat panel display apparatus of claim 5 wherein said coating material is comprised of $La_xBa_{(1-x)}TiO_3$.

7. The flat panel display apparatus of claim 3 wherein said transitional metals A and B have the same valence and have different energy unoccupied states in the band gap.

8. The flat panel display apparatus of claim 7 wherein said coating material is comprised of $SrTi_xZr_{(1-x)}O_3$.

9. The flat panel display apparatus of claim 3 wherein said transitional metals A and B are atoms of different size and are mixed on the same lattice site.

10. The flat panel display apparatus of claim 9 wherein said coating material is comprised of $La_xY_{(1-x)}CrO_3$.

11. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a combination of boron nitride and carbon.

12. The flat panel display apparatus of claim 11 wherein said combination of boron nitride and carbon is deposited to approximately 15 Angstroms.

13. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of an oxygen releasing material.

14. The flat panel display apparatus of claim 13 wherein said oxygen releasing material is an oxidizer.

15. The flat panel display apparatus of claim 13 wherein said coating material is selected from the group consisting of: perchlorates, peroxides, and nitrates.

16. The flat panel display apparatus of claim 13 wherein said coating material is comprised of $KClO_4$.

17. A flat panel display apparatus comprising:

a faceplate;

a backplate disposed opposing said faceplate, said faceplate and said backplate adapted to be connected in a sealed environment such that a low pressure region exists between said faceplate and said backplate; and a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure, wherein said spacer structure is comprised of an oxygen releasing material.

18. The flat panel display apparatus of claim 17 wherein said oxygen releasing material is an oxidizer.

19. A flat panel display apparatus comprising:

a faceplate;

a backplate disposed opposing said faceplate, said faceplate and said backplate adapted to be connected in a sealed environment such that a low pressure region exists between said faceplate and said backplate; and a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure, wherein said spacer structure is comprised of a material selected from the group consisting of: perchlorates, peroxides, and nitrates.

20. The flat panel display apparatus of claim 17 wherein said spacer structure is comprised of $KClO_4$.

21. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of insulated metal-containing particles.

22. The flat panel display apparatus of claim 21 wherein said insulated metal-containing particles are comprised of a core of metal material at least partially encapsulated by an insulating shell.

23. The flat panel display apparatus of claim 22 wherein said insulating shell has sufficient thickness such that, at low incident electron energies, electrons will not penetrate said insulating shell.

24. The flat panel display apparatus of claim 22 wherein said insulating shell has sufficient thickness such that, at high incident electron energies, electrons will penetrate said insulating shell.

25. The flat panel display apparatus of claim 22 wherein said insulating shell has approximately 20–200 Angstroms.

26. The flat panel display apparatus of claim 22 wherein said core of metal material has a diameter of approximately 1,000–10,000 Angstroms.

27. The flat panel display apparatus of claim 21 wherein said core of metal material is formed of material selected from the group consisting of: Si, Al, Ti, Cr, Zr, La, Ce, Pr, Nd, Pm, Sm, Eu, Gd, Tb, Dy, Ho, Er, Tm, Yb, and Lu.

28. The flat panel display apparatus of claim 22 wherein said insulating shell is comprised of oxygen reacted with material selected from the group consisting of: Si, Al, Ti, Cr, Zr, La, Ce, Pr, Nd, Pm, Sm, Eu, Gd, Tb, Dy, Ho, Er, Tm, Yb, and Lu.

29. The flat panel display apparatus of claim 22 wherein said insulating shell is comprised of nitrogen reacted with material selected from the group consisting of: Si, Al, Ti, Cr, Zr, La, Ce, Pr, Nd, Pm, Sm, Eu, Gd, Tb, Dy, Ho, Er, Tm, Yb, and Lu.

30. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of metal material impregnated into a porous matrix.

31. The flat panel display apparatus of claim 30 wherein said metal material impregnated into a porous matrix is comprised of a zeolite structure.

32. The flat panel display apparatus of claim 21 wherein said insulated metal-containing particles are dip-coated onto said spacer structure.

33. The flat panel display apparatus of claim 21 wherein said insulated metal-containing particles are spray-coated onto said spacer structure.

34. The flat panel display apparatus of claim 21 wherein said insulated metal-containing particles are suspended in a colloidal solution during application to said spacer structure.

35. The flat panel display apparatus of claim 21 wherein said insulated metal-containing particles are applied to said spacer structure such that said insulated metal-containing particles are substantially separated from each other.

36. The flat panel display apparatus of claim 30 wherein said metal material impregnated into said porous matrix is dip-coated onto said spacer structure.

37. The flat panel display apparatus of claim 30 wherein said metal material impregnated into said porous matrix is spray-coated onto said spacer structure.

38. The flat panel display apparatus of claim 30 wherein said metal material impregnated into said porous matrix is suspended in a colloidal solution during application to said spacer structure.

39. The flat panel display apparatus of claim 30 wherein said metal material impregnated into said porous matrix is applied to said spacer structure such that adjacent particles of said metal material impregnated into said porous matrix are substantially separated from each other.

40. A flat panel display apparatus comprising:

a faceplate;

a backplate disposed opposing said faceplate said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said stacker structure, wherein said coating material is comprised of $CeO_2$ doped with lanthanide ions such that resistivity of said coating material is stabilized against variations in oxygen-related parameters occurring during operation of said flat panel display apparatus.

41. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $CeO_2$ doped with Cr ions such that resistivity of said coating material is stabilized against variations in oxygen-related parameters occurring during operation of said flat panel display apparatus.

42. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display generating voltages, said spacer assembly further including a spacer structure; and a coating material applied to at least a portion of said spacer structure, wherein said coating material is comprised of $CeO_2$ doped with Ni ions such that resistivity of said coating material is stabilized against variations in oxygen-related parameters occurring during operation of said flat panel display apparatus.

43. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiN which was deposited onto and annealed to a layer of boron nitride.

44. The flat panel display apparatus of claim 43 wherein said layer of TiN was deposited to a thickness of approximately 10–300 Angstroms onto said layer of boron nitride.

45. The flat panel display apparatus of claim 43 wherein said layer of boron nitride, onto which said layer of TiN was deposited, has approximately 50–2000 Angstroms.

46. The flat panel display apparatus of claim 43 wherein said layer of TiN was deposited onto said layer of boron nitride in the presence of $N_2$.

47. The flat panel display apparatus of claim 46 wherein said layer of TiN was deposited onto said layer of boron nitride in the presence of said $N_2$ at a partial pressure of approximately 20–100 milliTorr.

48. The flat panel display apparatus of claim 43 wherein said layer of TiN and boron nitride is annealed at a temperature of approximately 500–900 degrees Celsius.

49. The flat panel display apparatus of claim 48 wherein said layer of TiN and boron nitride is annealed at a temperature of approximately 500–900 degrees Celsius in an $N_2$ atmosphere.

50. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiAl which was deposited onto and annealed to a layer of boron nitride.

51. The flat panel display apparatus of claim 50 wherein said layer of TiAl was deposited to a thickness of approximately 10–300 Angstroms onto said layer of boron nitride.

52. The flat panel display apparatus of claim 50 wherein said layer of boron nitride, onto which said layer of TiN was deposited, has approximately 50–2000 Angstroms.

53. The flat panel display apparatus of claim 50 wherein said layer of TiAl was deposited onto said layer of boron nitride in the presence of $N_2$.

54. The flat panel display apparatus of claim 53 wherein said layer of TiAl was deposited onto said layer of boron nitride in the presence of said $N_2$ at a partial pressure of approximately 20–100 milliTorr.

55. The flat panel display apparatus of claim 50 wherein said layer of TiAl and boron nitride is annealed at a temperature of approximately 500–900 degrees Celsius.

56. The flat panel display apparatus of claim 55 wherein said layer of TiAl and boron nitride is annealed at a temperature of approximately 500–900 degrees Celsius in an $N_2$ atmosphere.

57. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiN overlying a layer of boron nitride.

58. The flat panel display apparatus of claim 57 wherein said layer of TiN has approximately 10–300 Angstroms.

59. The flat panel display apparatus of claim 57 wherein said layer of boron nitride has a thickness of approximately 50–2000 Angstroms.

60. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiAl overlying a layer of boron nitride.

61. The flat panel display apparatus of claim 60 wherein said layer of TiAl has approximately 10–300 Angstroms.

62. The flat panel display apparatus of claim 60 wherein said layer of boron nitride has a thickness of approximately 50–2000 Angstroms.

63. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said spacer structure is comprised of ceramic boron nitride.

64. The flat panel display apparatus of claim 63 wherein said coating material is comprised of a layer of TiN which has been deposited onto and annealed with said ceramic boron nitride spacer structure.

65. The flat panel display apparatus of claim 63 wherein said layer of TiN was deposited to a thickness of approximately 10–300 Angstroms onto said ceramic boron nitride spacer structure.

66. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $Nd_2O_3$.

67. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a material selected from the group consisting of: $Cr_2O_3$-$Nd_2O_3$, $Nd_2O_3$-MnO, and $Cr_2O_3$-MnO.

68. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is formed of a first layer of material and a second layer of material wherein said first layer of material and said second layer of material have different electron densities.

69. A flat panel display apparatus comprising:

a faceplate;

a backplate disposed opposing said faceplate, said faceplate and said backplate adapted to be connected in a sealed environment such that a low pressure region exists between said faceplate and said backplate;

a spacer assembly disposed within said sealed environment, said spacer assembly supporting said faceplate and said backplate against forces acting in a direction towards said sealed environment, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is formed of a first layer of comprised of $Cr_2O_3$ and a second layer comprised of $Nd_2O_3$.

70. The flat panel display apparatus of claim 69 wherein said first layer comprised of $Cr_2O_3$ has thickness of approximately 30 Angstroms.

71. The flat panel display apparatus of claim 69 wherein said second layer comprised of $Nd_2O_3$ has thickness of approximately 100 Angstroms.

72. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure, wherein said spacer structure is comprised of alumina doped with cerium oxide.

73. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layered material that is oriented with its basal plane parallel to a face of said spacer structure.

74. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layered material, wherein said layered material is a semimetal.

75. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a metal oxide having the composition $ABO_3$, where A and B are transition metals.

76. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised, of a metal oxide having the composition $A_2BO_4$, where A and B are transition metals.

77. The spacer assembly of claim 75 wherein said transitional metals A and B are mixed with alternating valence.

78. The spacer assembly of claim 77 wherein said coating material is comprised of $La_xBa_{(1-x)}TiO_3$.

79. The spacer assembly of claim 75 wherein said transitional metals A and B have the same valence and have different,energy unoccupied states in the band gap.

80. The spacer assembly of claim 79 wherein said coating material is comprised of $SrTixZr_{(1-x)}O_3$.

81. The spacer assembly of claim 75 wherein said transitional metals A and B are atoms of different size and are mixed on the same lattice site.

82. The spacer assembly of claim 81 wherein said coating material is comprised of $La_xY_{(1-x)}CrO_3$.

83. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of boron nitride.

84. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a combination of boron nitride and carbon.

85. The spacer assembly of claim 84 wherein said combination of boron nitride and carbon is deposited to a thickness of greater than approximately 15 Angstroms.

86. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of an oxygen releasing material.

87. The spacer assembly of claim 86 wherein said oxygen releasing-material is an oxidizer.

88. The spacer assembly of claim 86 wherein said coating material is selected from the group consisting of: perchlorates, peroxides, and nitrates.

89. The spacer assembly of claim 86 wherein said coating material is comprised of $KClO_4$.

90. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure, wherein said spacer structure is comprised of an oxygen releasing material.

91. The spacer assembly of claim 90 wherein said oxygen releasing material is an oxidizer.

92. The spacer assembly of claim 90 wherein said spacer structure is comprised of a material selected from the group consisting of: perchlorates, peroxides, and nitrates.

93. The spacer assembly of claim 90 wherein said spacer structure is comprised of $KClO_4$.

94. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of insulated metal-containing particles.

95. The spacer assembly of claim 94 wherein said insulated metal-containing particles are comprised of a core of metal material at least partially encapsulated by an insulating shell.

96. The spacer assembly of claim 95 wherein said insulating shell has sufficient thickness such that, at low flat panel display operating voltages, electrons will not penetrate said insulating shell.

97. The spacer assembly of claim 95 wherein said insulating shell has sufficient thickness such that, at high flat panel display operating voltages, electrons will penetrate said insulating shell.

98. The spacer assembly of claim 95 wherein said insulating shell has approximately 20–200 Angstroms.

99. The spacer assembly of claim 95 wherein said core of metal material has approximately 1,000–10,000 Angstroms.

100. The spacer assembly of claim 95 wherein said core of metal material is formed of material selected from the group consisting of: Si, Al, Ti, Cr, Zr, La, Ce, Pr, Nd, Pm, Sm, Eu, Gd, Tb, Dy, Ho, Er, Tm, Yb, and Lu.

101. The spacer assembly of claim 95 wherein said insulating shell is comprised of oxygen reacted with material selected from the group consisting of: Si, Al, Ti, Cr, Zr, La, Ce, Pr, Nd, Pm, Sm, Eu, Gd, Tb, Dy, Ho, Er, Tm, Yb, and Lu.

102. The spacer assembly of claim 95 wherein said insulating shell is comprised of nitrogen reacted with material selected from the group consisting of: Si, Al, Ti, Cr, Zr, La, Ce, Pr, Nd, Pm, Sm, Eu, Gd, Tb, Dy, Ho, Er, Tm, Yb, and Lu.

103. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of metal material impregnated into a porous matrix.

104. The spacer assembly of claim 103 wherein said metal material impregnated into a porous matrix is comprised of a zeolite structure.

105. The spacer assembly of claim 94 wherein said insulated metal-containing particles are dip-coated onto said spacer structure.

106. The spacer assembly of claim 94 wherein said insulated metal-containing particles are spray-coated onto said spacer structure.

107. The spacer assembly of claim 94 wherein said insulated metal-containing particles are suspended in a colloidal solution during application to said spacer structure.

108. The spacer assembly of claim 94 wherein said insulated metal-containing particles are applied to said spacer structure such that said insulated metal-containing particles are substantially separated from each other.

109. The spacer assembly of claim 103 wherein said metal material impregnated into said porous matrix is dip-coated onto said spacer structure.

110. The spacer assembly of claim 103 wherein said metal material impregnated into said porous matrix is spray-coated onto said spacer structure.

111. The spacer assembly of claim 103 wherein said metal material impregnated into said porous matrix is suspended in a colloidal solution during application to said spacer structure.

112. The spacer assembly of claim 103 wherein said metal material impregnated into said porous matrix is applied to said spacer structure such that adjacent particles of said metal material impregnated into said porous matrix are substantially separated from each other.

113. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $CeO_2$ doped with lanthanide ions such that resistivity of said coating material is stabilized against variations in oxygen-related parameters occurring during operation of said flat panel display apparatus.

114. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $CeO_2$ doped with Cr ions such that resistivity of said coating material is stabilized against variations in oxygen-related parameters occurring during operation of said flat panel display apparatus.

115. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $CeO_2$ doped with Ni ions such that resistivity of said coating material is stabilized against variations in oxygen-related parameters occurring during operation of said flat panel display apparatus.

116. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiN which was deposited onto and annealed to a layer of boron nitride.

117. The spacer assembly of claim 116 wherein said layer of TiN was deposited to approximately 10–300 Angstroms onto said layer of boron nitride.

118. The spacer assembly of claim 116 wherein said layer of boron nitride, onto which said layer of TiN was deposited, has approximately 50–2000 Angstroms.

119. The spacer assembly of claim 116 wherein said layer of TiN was deposited onto said layer of boron nitride in the presence of $N_2$.

120. The spacer assembly of claim 119 wherein said layer of TiN was deposited onto said layer of boron nitride in the presence of said $N_2$ at a partial pressure of approximately 20–100 milliTorr.

121. The spacer assembly of claim 116 wherein said layer of TiN and boron nitride is annealed at a temperature of approximately 500–900 degrees Celsius.

122. The spacer assembly of claim 121 wherein said layer of TiN and boron nitride is annealed at a temperature of approximately 500–900 degrees Celsius in an $N_2$ atmosphere.

123. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiAl which was deposited onto and annealed to a layer of boron nitride.

124. The spacer assembly of claim 123 wherein said layer of TiAl was deposited to approximately 10–300 Angstroms onto said layer of boron nitride.

125. The spacer assembly of claim 123 wherein said layer of boron nitride, onto which said layer of TiN was deposited, has approximately 50–2000 Angstroms.

126. The spacer assembly of claim 123 wherein said layer of TiAl was deposited onto said layer of boron nitride in the presence of $N_2$.

127. The spacer assembly of claim 126 wherein said layer of TiAl was deposited onto said layer of boron nitride in the presence of said $N_2$ approximately 20–100 milliTorr.

128. The spacer assembly of claim 123 wherein said layer of TiAl and boron nitride is annealed at a temperature of approximately 500–900 degrees Celsius.

129. The spacer assembly of claim 128 wherein said layer of TiAl and boron nitride is annealed at a temperature of approximately 500–900 degrees Celsius in an $N_2$ atmosphere.

130. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiN overlying a layer of boron nitride.

131. The spacer assembly of claim 130 wherein said layer of TiN has approximately 10–300 Angstroms.

132. The spacer assembly of claim 130 wherein said layer of boron nitride has approximately 50–2000 Angstroms.

133. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a layer of TiAl overlying a layer of boron nitride.

134. The spacer assembly of claim 133 wherein said layer of TiAl has approximately 10–300 Angstroms.

135. The spacer assembly of claim 133 wherein said layer of boron nitride has approximately 50–2000 Angstroms.

136. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said spacer structure is comprised of ceramic boron nitride.

137. The spacer assembly of claim 136 wherein said coating material is comprised of a layer of TiN which has been deposited onto and annealed with said ceramic boron nitride spacer structure.

138. The spacer assembly of claim 137 wherein said layer of TiN was deposited to a thickness of approximately 10–300 Angstroms onto said ceramic boron nitride spacer structure.

139. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of $Nd_2O_3$.

140. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is comprised of a material selected from the group consisting of: $Cr_2O_3$-$Nd_2O_3$, $Nd_2O_3$-MnO, and $Cr_2O_3$-MnO.

141. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is formed of a first layer of material and a second layer of material wherein said first layer of material and said second layer of material have different electron densities.

142. A spacer assembly for use in a field emission display device, said spacer assembly adapted to support a faceplate and a backplate against forces acting in a direction towards each other, said spacer assembly tailored to provide a secondary electron emission coefficient of approximately 1 for said spacer assembly when said spacer assembly is subjected to flat panel display operating voltages, said spacer assembly further including a spacer structure; and a coating material applied to at least a portion of said spacer structure, wherein said coating material is formed of a first layer of comprised of $Cr_2O_3$ and a second layer comprised of $Nd_2O_3$.

143. The spacer assembly of claim 142 wherein said first layer comprised of $Cr_2O_3$ has thickness of approximately 30 Angstroms.

144. The spacer assembly of claim 142 wherein said second layer comprised of $Nd_2O_3$ has thickness of approximately 100 Angstroms.

* * * * *